US009601048B2

(12) United States Patent
Yano et al.

(10) Patent No.: US 9,601,048 B2
(45) Date of Patent: Mar. 21, 2017

(54) IMAGE PROCESSING DEVICE AND ELECTRONIC APPARATUS

(71) Applicant: Sony Corporation, Tokyo (JP)

(72) Inventors: Tomoya Yano, Kanagawa (JP); Yasuo Inoue, Tokyo (JP); Yohei Funatsu, Kanagawa (JP)

(73) Assignee: Sony Corporation, Tokyo (JP)

( * ) Notice: Subject to any disclaimer, the term of this patent is extended or adjusted under 35 U.S.C. 154(b) by 55 days.

(21) Appl. No.: 14/638,591

(22) Filed: Mar. 4, 2015

(65) Prior Publication Data

US 2015/0279284 A1 Oct. 1, 2015

(30) Foreign Application Priority Data

Mar. 25, 2014 (JP) ..... 2014-062569

(51) Int. Cl.
*G09G 5/10* (2006.01)
*G09G 3/32* (2016.01)

(52) U.S. Cl.
CPC ... *G09G 3/3208* (2013.01); *G09G 2300/0452* (2013.01); *G09G 2320/041* (2013.01); *G09G 2320/045* (2013.01); *G09G 2320/0666* (2013.01); *G09G 2330/021* (2013.01); *G09G 2340/06* (2013.01)

(58) Field of Classification Search
CPC ..... G09G 2320/0276; G09G 2360/16; G09G 2320/0626
USPC ..... 345/76–83, 87–89, 211–213, 690–693
See application file for complete search history.

(56) References Cited

U.S. PATENT DOCUMENTS

2014/0015865 A1* 1/2014 Kim ..... G09G 5/10 345/690
2014/0152708 A1* 6/2014 Park ..... G09G 3/3208 345/690

FOREIGN PATENT DOCUMENTS

JP 2010-524044 A 7/2010

* cited by examiner

*Primary Examiner* — Kimnhung Nguyen
(74) *Attorney, Agent, or Firm* — Michael Best & Friedrich LLP

(57) ABSTRACT

Provided is an image processing device including a luminance information generating unit that generates fourth luminance information, which becomes the basis of luminance of a fourth pixel, on the basis of variation characteristics with the passage of time regarding light-emission luminance in the fourth pixel of a display unit including a first pixel, a second pixel, and a third pixel which emit three basic color light beams, and the fourth pixel that emits a non-basic color light beam, and first luminance information, second luminance information, and third luminance information which correspond to the first pixel, the second pixel, and the third pixel, respectively.

20 Claims, 23 Drawing Sheets

IMAGE PROCESSING DEVICE AND ELECTRONIC APPARATUS

CROSS REFERENCE TO RELATED APPLICATIONS

This application claims the benefit of Japanese Priority Patent Application JP 2014-062569 filed Mar. 25, 2014, the entire contents of which are incorporated herein by reference.

BACKGROUND

The present disclosure relates to an image processing device that processes an image and an electronic apparatus including the image processing device.

Recently, replacement from a cathode ray tube (CRT) display device to a liquid crystal display device or an organic electro-luminescence (EL) display device has been in progress. In comparison to the CRT display device, the liquid crystal display device or the EL display device can lower power consumption and can be constructed as a thin display device. Accordingly, the liquid crystal display device or the EL display device has been the mainstream for display devices.

However, in display devices, for example, each pixel may be constituted by four sub-pixels including red (R), green (G), blue (B), and white (W) sub-pixels. In the display devices, display is performed by changing luminance of each of the sub-pixels in accordance with a signal level (luminance information). At that time, for example, chromaticity of white light that is emitted from the white sub-pixel may vary in accordance with the signal level. For example, Japanese Unexamined Patent Application Publication (Translation of PCT Application) No. 2010-524044 discloses a method of correcting the variation in chromaticity.

SUMMARY

However, an electronic apparatus is typically demanded to have low power consumption, and an additional reduction in power consumption is also expected for an image processing device.

It is desirable to provide an image processing device and an electronic apparatus which are capable of reducing power consumption.

According to an embodiment of the present disclosure, there is provided an image processing device including a luminance information generating unit. The luminance information generating unit generates fourth luminance information, which becomes the basis of luminance of a fourth pixel, on the basis of variation characteristics with the passage of time regarding light-emission luminance in the fourth pixel of a display unit including a first pixel, a second pixel, and a third pixel which emit three basic color light beams, and the fourth pixel that emits a non-basic color light beam, and first luminance information, second luminance information, and third luminance information which correspond to the first pixel, the second pixel, and the third pixel, respectively.

According to another embodiment of the present disclosure, there is provided an electronic apparatus including the image processing device. The electronic apparatus corresponds to a television apparatus, an electronic book, a smart phone, a digital still camera, a note-type personal computer, a video camera, a head mount display, and the like.

In the image processing device and the electronic apparatus according to the embodiments of the present disclosure, the fourth luminance information, which becomes the basis of the luminance of the fourth pixel that emits a non-basic color light beam, is generated. The fourth luminance information is generated on the basis of the variation characteristics with the passage of time regarding light-emission luminance in the fourth pixel, the first luminance information, the second luminance information, and the third luminance information.

According to the image processing device and the electronic apparatus of the embodiments of the present disclosure, the fourth luminance information is configured to be generated on the basis of the variation characteristics with the passage of time regarding the light-emission luminance in the fourth pixel, the first luminance information, the second luminance information, and the third luminance information, and thus it is possible to reduce power consumption. In addition, the effect described here is not restricted, and may be any effect described in the present disclosure.

DETAILED DESCRIPTION OF EMBODIMENTS

Hereinafter, embodiments of the present disclosure will be described in detail with reference to the attached drawings. In addition, description will be made in the following sequence.

1. First Embodiment
2. Second Embodiment
3. Third Embodiment
4. Application Example

1. First Embodiment

Configuration Example

Overall Configuration Example

Figure 1:
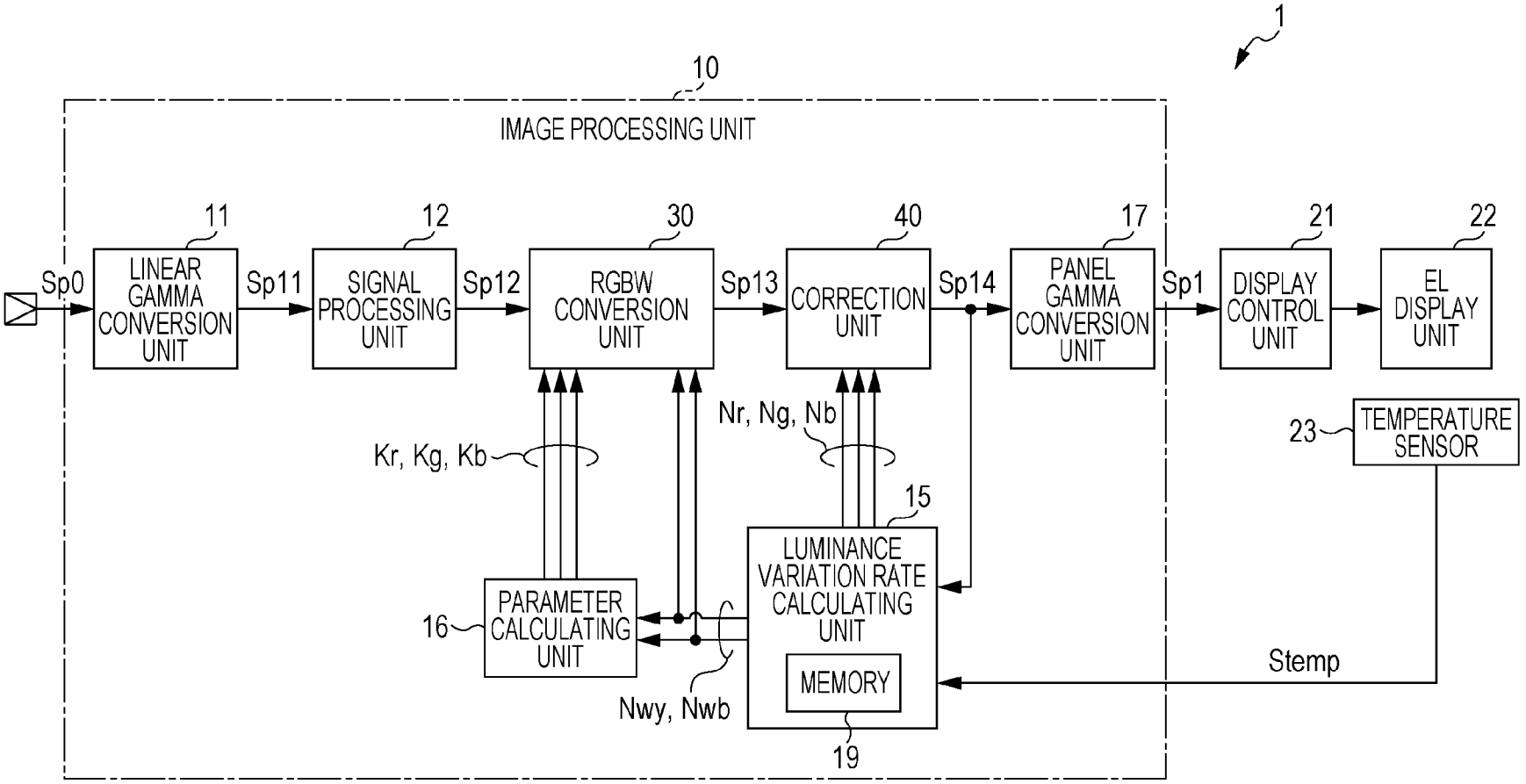
FIG. 1 is a block diagram illustrating a configuration example of a display device according to a first embodiment of the present disclosure.

FIG. 1 illustrates a configuration example of a display device according to a first embodiment. The display device 1 is an EL display device that uses an organic EL display element as a display element. In addition, an image processing device and an electronic apparatus according to embodiments of the present disclosure are realized by this embodiment, and thus description thereof will be made in combination with this embodiment.

The display device 1 displays an image on the basis of an image signal Sp0. In this example, the image signal Sp0 is a so-called RGB signal including red (R) luminance information IR, green (G) luminance information IG, and blue (B) luminance information IB.

The display device 1 includes an image processing unit 10, a display control unit 21, an EL display unit 22, and a temperature sensor 23. The image processing unit 10 generates an image signal Sp1 on the basis of the image signal Sp0 and a temperature signal Stemp. The display control unit 21 performs timing control of a display operation in the EL display unit 22 on the basis of the image signal Sp1. The EL display unit 22 is a display unit using an organic EL display element as a display element, and performs a display operation on the basis of control by the display control unit 21. The temperature sensor 23 detects a temperature (panel temperature) in the EL display unit 22, and outputs the detection result as the temperature signal Stemp.

Figure 2:
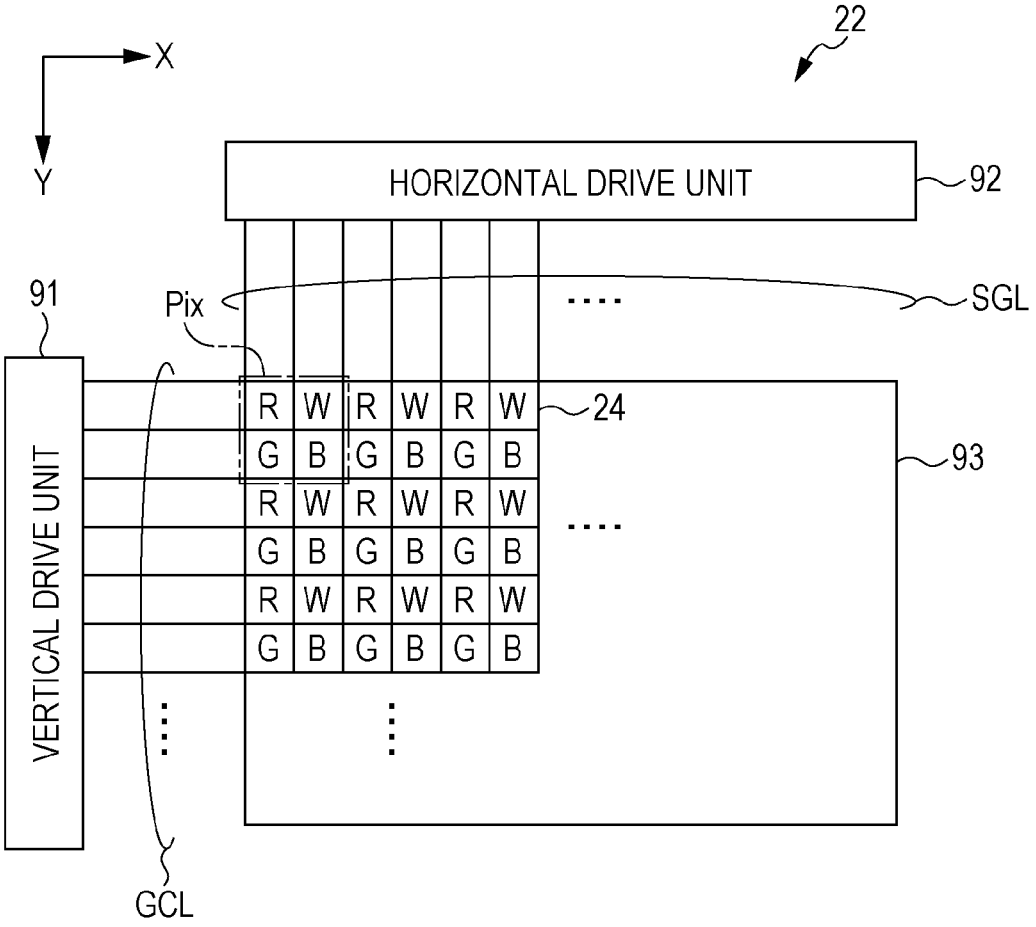
FIG. 2 is a block diagram illustrating a configuration example of an EL display unit illustrated in FIG. 1.

FIG. 2 illustrates a configuration example of the EL display unit 22. The EL display unit 22 includes a pixel array unit 93, a vertical drive unit 91, and a horizontal drive unit 92.

In the pixel array unit 93, pixels Pix are arranged in a matrix form. In this example, each of the pixels Pix is constituted by four red (R), greed (G), blue (B), and white (W) sub-pixels 24 (24R, 24G, 24B, and 24W). In this example, in the pixel Pix, the four sub-pixels 24 are arranged in two rows and two columns. Specifically, in the pixel Pix, the red (R) sub-pixel 24R is arranged on an upper-left side, the green (G) sub-pixel 24G is arranged on a lower-left side, the white (W) sub-pixel 24W is arranged on an upper-right side, and the blue (B) sub-pixel 24B is arranged on a lower-right side. In addition, arrangement of the four sub-pixels 24 is not limited thereto, and may be performed in an arbitrary order.

Figure 3:
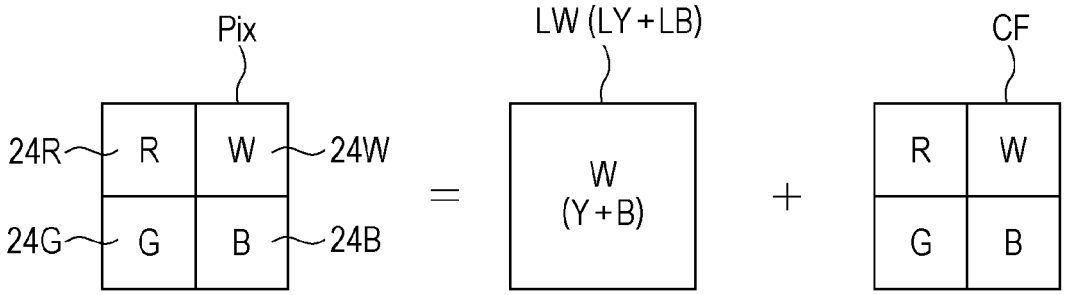
FIG. 3 is a schematic view illustrating a configuration example of a pixel illustrated in FIG. 2.

FIG. 3 schematically illustrates a configuration of the pixel Pix. The pixel array unit 93 includes a white light-emitting layer LW, and a color filter CF. The white light-emitting layer LW is constructed by laminating an organic EL layer (yellow light-emitting layer LY) that emits a yellow (Y) light beam and an organic EL layer (blue light-emitting layer LB) that emits a blue (B) light beam. In addition, the yellow light beam that is emitted from the yellow light-emitting layer LY and a blue light beam that is emitted from the blue light-emitting layer LB are mixed with each other, and are emitted from the white light-emitting layer LW as a white light beam. In the red sub-pixel 24R, a red color component is separated from the white light beam by a red color filter CF, and is emitted. Similarly, in the green sub-pixel 24G, a green color component is separated from the white light beam by a green color filter CF, and is emitted. In the blue sub-pixel 24B, a blue color component is separated from the white light beam by a blue color filter CF, and is emitted. In the white sub-pixel 24W, a color gamut of the white light beam is adjusted by the white color filter CF. In addition, in an application in which a demand for an image quality (color gamut) is not so high, and the like, the white (W) color filter CF may not be provided.

Typically, in the organic EL layer, light-emission luminance varies due to a variation with the passage of time. Specifically, in this example, the luminance of the yellow light beam that is emitted from the yellow light-emitting layer LY decreases with the passage of time, and the luminance of the blue light beam that is emitted from the blue light-emitting layer LB decreases with the passage of time. Accordingly, in each of the sub-pixels 24, luminance decreases due to a variation with the passage of time. In addition, particularly, in the white sub-pixel 24W, in a case where a luminance variation rate with the passage of time in the yellow light-emitting layer LY and a luminance variation rate with the passage of time in the blue light-emitting layer LB are different from each other, chromaticity is also apt to vary with the passage of time. The higher a current density is, the longer a light-emission time is, and the higher a temperature is, the more the variation in luminance or chromaticity with the passage of time becomes significant. As described later, the image processing unit 10 is configured in such a manner that image processing is performed in advance in consideration of the variation in the light-emitting characteristics with the passage of time in the EL display unit 22.

The vertical drive unit 91 generates a scanning signal on the basis of timing control by the display control unit 21, and supplies the scanning signal to the pixel array unit 93 through a gate line GCL so as to perform line sequential scanning by sequentially selecting the sub-pixel 24 in the pixel array unit 93.

The horizontal drive unit 92 generates a pixel signal on the basis of timing control by the display control unit 21, and supplies the pixel signal to the pixel array unit 93 through a data line SGL so as to supply the pixel signal to each of the sub-pixels 24 of the pixel array unit 93.

In the display device 1, an image is displayed by the four sub-pixels 24 as described above, and thus power consumption can be reduced. That is, for example, in a display device including three red, green, and blue sub-pixels, in a case of displaying a white color, the three sub-pixels are allowed to emit a light beam. However, in the display device 1, instead of this configuration, the white sub-pixel 24W is mainly allowed to emit a light beam, and thus the display device 1 is configured to reduce power consumption.

Image Processing Unit 10

The image processing unit 10 includes a linear gamma conversion unit 11, a signal processing unit 12, a parameter calculating unit 16, an RGBW conversion unit 30, a correction unit 40, a luminance variation rate calculating unit 15, and a panel gamma conversion unit 17.

The linear gamma conversion unit 11 converts (linear gamma conversion) the input image signal Sp0 to an image signal Sp11 having linear gamma characteristics. That is, the image signal Sp0 that is supplied from the outside has non-linear gamma characteristics in consideration of characteristics of a typical display device. Accordingly, the linear gamma conversion unit 11 converts the non-linear gamma characteristics to the linear gamma characteristics for easy processing in the signal processing unit 12, the RGBW conversion unit 30, and the like. For example, the linear gamma conversion unit 11 has a look-up table, and is configured to perform the gamma conversion by using the look-up table.

The signal processing unit 12 performs predetermined signal processing with respect to the image signal Sp11, and outputs the result as image signal Sp12. Examples of the predetermined signal processing include conversion (a so-called color gamut conversion) of a color gamut and a color temperature which are expressed by the image signal Sp11 to a color gamut and a color temperature of the EL display unit 22, and the like.

The parameter calculating unit 16 obtains parameters Kr, Kg, and Kb on the basis of luminance variation rates Nwy and Nwb. The luminance variation rate Nwy indicates a variation in luminance with the passage of time regarding a yellow color component in a white light beam emitted from the white (W) sub-pixel 24W. That is, the luminance variation rate Nwy mainly corresponds to a variation in the light-emitting characteristics with the passage of time in the yellow light-emitting layer LY of the sub-pixel 24W. Similarly, the luminance variation rate Nwb indicates a variation in luminance with the passage of time regarding a blue color component in a white light beam emitted from the white (W) sub-pixel 24W. That is, the luminance variation rate Nwb mainly corresponds to a variation in the light-emitting characteristics with the passage of time in the blue light-emitting layer LB of the sub-pixel 24W. With regard to the luminance variation rates Nwy and Nwb, for example, an initial value thereof is "1", and the luminance variation rates Nwy and Nwb decrease from the initial value with the passage of time.

The RGBW conversion unit 30 generates an RGBW signal on the basis of the image signal Sp12 that is an RGB signal, the parameters Kr, Kg, and Kb, and the luminance variation rates Nwy and Nwb, and outputs the RGBW signal as an image signal Sp13. Specifically, the RGBW conversion unit 30 is configured to convert (RGBW-converts) an RGB signal including luminance information IR, luminance information IG, and luminance information IB of three colors including red (R), green (G), and blue (B) to an RGBW signal including luminance information IR2, luminance information IG2, luminance information IB2, and luminance information IW2 of four colors including red (R), green (G), blue (B), and white (W).

Figure 4:
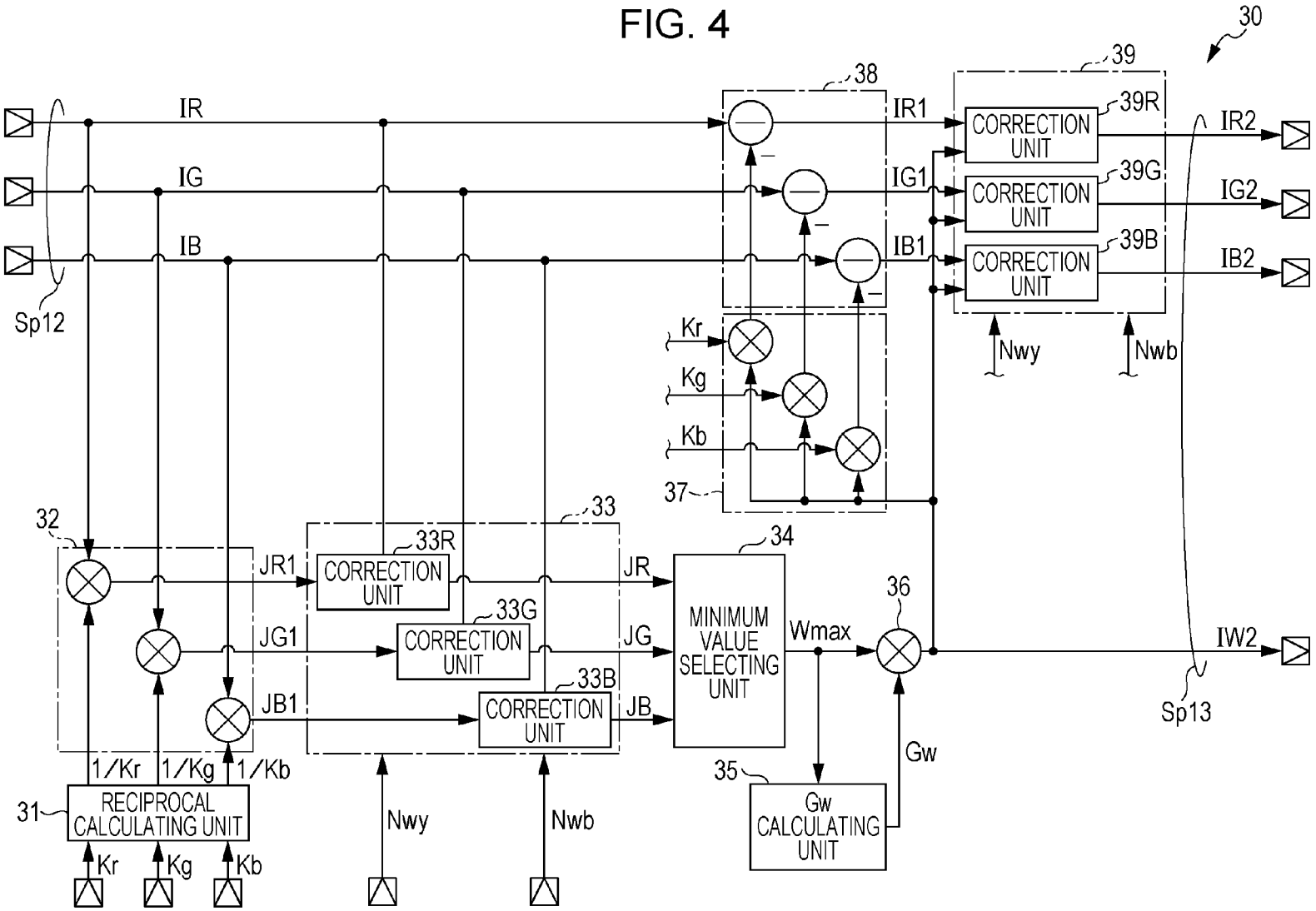
FIG. 4 is a block diagram illustrating a configuration example of an RGBW conversion unit illustrated in FIG. 1.

FIG. 4 illustrates a configuration example of the RGBW conversion unit 30. The RGBW conversion unit 30 includes a reciprocal calculating unit 31, a multiplication unit 32, a correction unit 33, a minimum value selecting unit 34, a Gw calculating unit 35, multiplication units 36 and 37, a subtraction unit 38, and a correction unit 39.

On the basis of the parameters Kr, Kg, and Kb, the reciprocal calculating unit 31 obtains reciprocals "1/Kr", "1/Kg", and "1/Kb" of the parameters, respectively.

The multiplication unit 32 and the correction unit 33 convert the luminance information IR, the luminance information IG, and the luminance information IB, which are included in the image signal Sp12, to luminance information JR, luminance information JG, and luminance information JB. Here, the luminance information JR is luminance information for realization of the luminance of the red light beam, which is obtained when the red sub-pixel 24R emits a light beam with the luminance information IR, by allowing the white sub-pixel 24W to emit a light beam. In other words, luminance of a red color compound in a white light beam when the white sub-pixel 24W is allowed to emit a light beam on the basis of the luminance information JR becomes the same as the luminance of the red light beam when the red sub-pixel 24R is allowed to emit a light beam with the luminance information IR. Similarly, the luminance information JG is luminance information for realization of the luminance of the green light beam, which is obtained when the green sub-pixel 24G emits a light beam with the luminance information IG, by allowing the white sub-pixel 24W to emit a light beam. In addition, the luminance information JB is luminance information for realization of the luminance of the blue light beam, which is obtained when the blue sub-pixel 24B is allowed to emit a light beam with the luminance information IB, by allowing the white sub-pixel 24W to emit a light beam.

Figure 5:
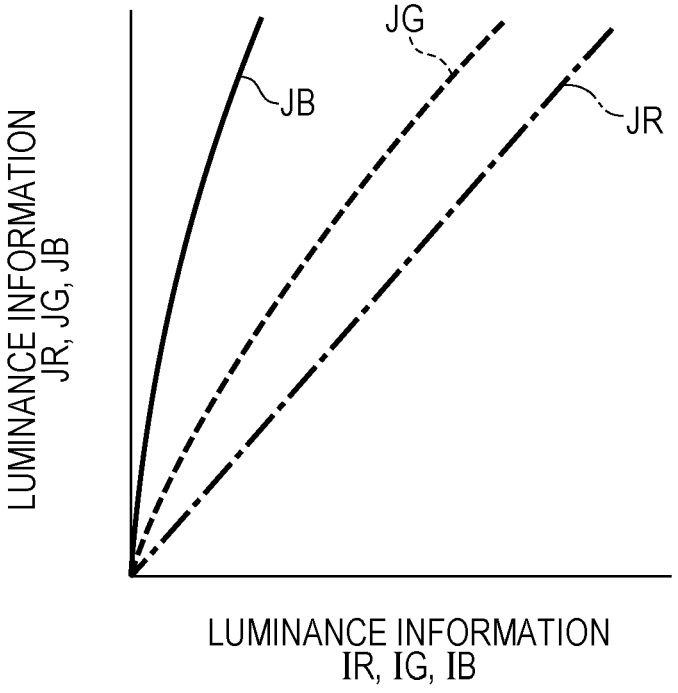
FIG. 5 is an explanatory view illustrating a characteristic example of a multiplication unit and a correction unit which are illustrated in FIG. 4.

FIG. 5 illustrates an example of conversion characteristics from the luminance information IR, the luminance information IG, and the luminance information IB to the luminance information JR, the luminance information JG, and the luminance information JB in the multiplication unit 32 and the correction unit 33. As illustrated in FIG. 5, the conversion characteristics may have linearity or non-linearity. Accordingly, as described above, the multiplication unit 32 and the correction unit 33 are configured to realize not only the linear conversion characteristics but also the non-linear conversion characteristics. In addition, the multiplication unit 32 and the correction unit 33 are configured to change the conversion characteristics in accordance with a variation in light-emitting characteristics with the passage of time in the white sub-pixel 24W.

Figure 6:
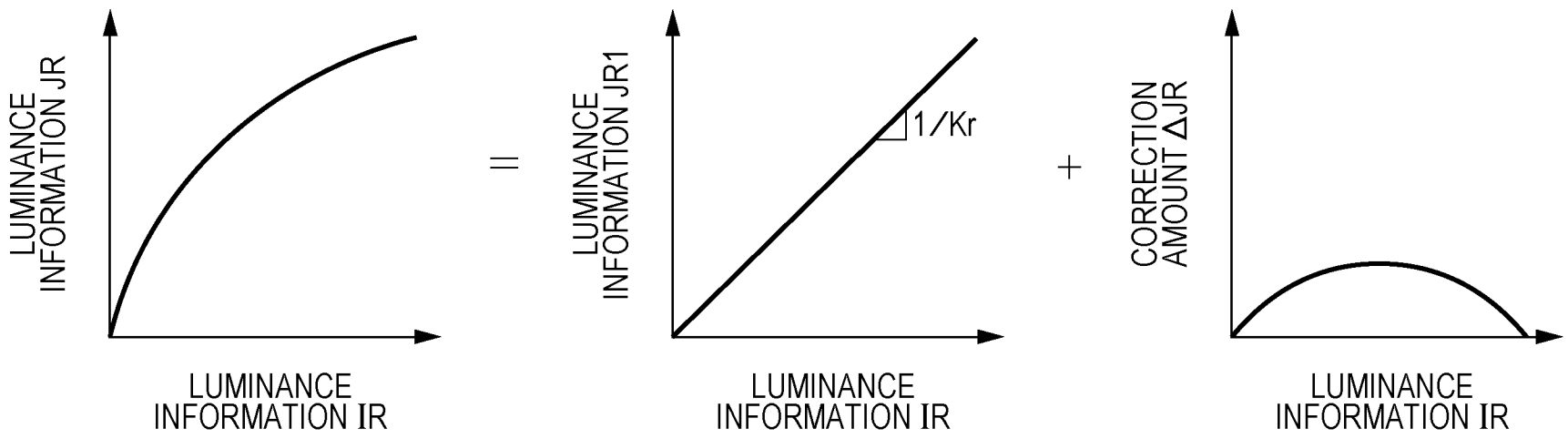
FIG. 6 is an explanatory view illustrating an operation example of the multiplication unit and the correction unit which are illustrated in FIG. 4.

FIG. 6 illustrates a conversion operation from the luminance information IR to the luminance information JR in the multiplication unit 32 and the correction unit 33. In the multiplication unit 32 and the correction unit 33, the luminance information IR is converted to the luminance information JR in two stages. Specifically, first, the multiplication unit 32 converts the luminance information IR to the luminance information JR1 through linear conversion. That is, the conversion characteristics from the luminance information IR to the luminance information JR1 have a linear type. In addition, the correction unit 33 adds a correction amount ΔJR to the luminance information JR1 so as to generate the luminance information JR. In this example, the conversion characteristics from the luminance information JR1 to the luminance information JR have a non-linear type. In addition, in this example, description has been given to the conversion operation from the luminance information IR to the luminance information JR, but the description is also true of a conversion operation from the luminance information IG to the luminance information JG, and a conversion operation from the luminance information IB to the luminance information JB. As described above, in the RGBW conversion unit 30, it is possible to realize the non-linear conversion characteristics by combining the multiplication unit 32 and the correction unit 33.

The multiplication unit 32 multiplies the luminance information IR, the luminance information IG, and the luminance information IB of each pixel, which are included in the image signal Sp12, by the reciprocals "1/Kr", "1/Kg", and "1/Kb" of the parameters Kr, Kg, and Kb, respectively. Specifically, the multiplication unit 32 multiplies the luminance information IR by "1/Kr" to generate the luminance information JR1. The multiplication unit 32 multiplies the luminance information IG by "1/Kg" to generate the luminance information JG1. The multiplication unit 32 multiplies the luminance information IB by "1/Kb" to generate the luminance information JB1. As described above, the multiplication unit 32 is configured to convert the luminance information IR, the luminance information IG, and the luminance information IB to the luminance information JR1, the luminance information JG1, and the luminance information JB1 through the linear conversion.

The correction unit 33 performs correction with respect to the luminance information JR1, the luminance information JG1, and the luminance information JB1 so as to generate the luminance information JR, the luminance information JG, and the luminance information JB. The correction unit 33 includes correction units 33R, 33G, and 33B.

The correction unit 33R obtains a correction amount ΔJR on the basis of the luminance information IR, and the luminance variation rates Nwy and Nwb, and adds the correction amount ΔJR to the luminance information JR1 to generate the luminance information JR. The correction unit 33R includes a plurality of look-up tables which are correlated with the luminance variation rates Nwy and Nwb. Each of the look-up tables indicates a relationship between the luminance information IR and the correction amount ΔJR. According to this configuration, first, the correction unit 33R selects one of the plurality of look-up tables on the basis of the luminance variation rates Nwy and Nwb. Next, the correction unit 33R obtains the correction amount ΔJR by linear interpolation on the basis of the luminance information IR by using the look-up table that is selected. In addition, the correction unit 33R is configured to generate the luminance information JR by adding the correction amount ΔJR to the luminance information JR1.

Figure 7:
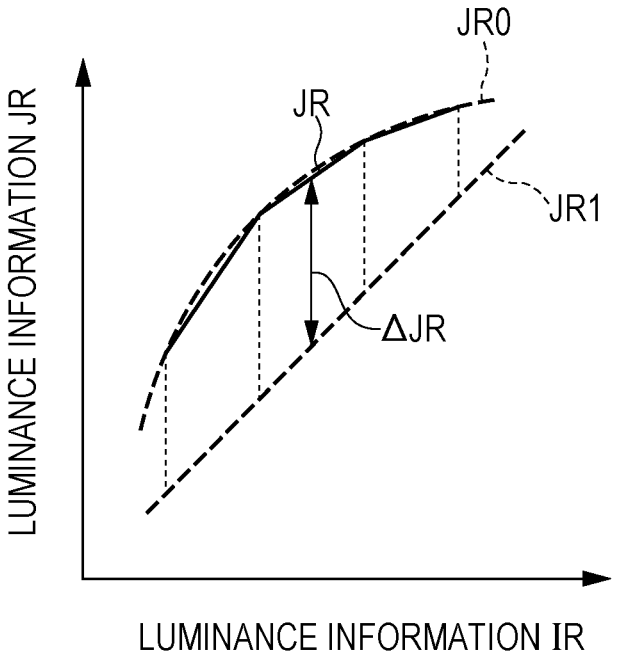
FIG. 7 is an explanatory view illustrating an operation example of the correction unit illustrated in FIG. 4.

FIG. 7 illustrates an operation example of the correction unit 33R. In addition, FIG. 7 is drawn in an exaggerated manner for ease of explanation. As described above, the correction unit 33R adds the correction amount ΔJR obtained by linear interpolation to the luminance information JR1 so as to generate the luminance information JR. At that time, the correction unit 33R performs the correction by using the look-up table, and thus a difference occurs between the luminance information JR that is obtained in this manner, and luminance information JR0 that is obtained according to ideal conversion characteristics. At that time, the correction unit 33R sets the correction amount ΔJR in such a manner that the luminance information JR becomes smaller than the luminance information JR0. According to this, it is possible to reduce a concern about a decrease in the image quality as described below.

In addition, in the multiplication unit 32 and the correction unit 33R, first, the multiplication unit 32 converts the luminance information IR to the luminance information JR1 through linear conversion, and the correction unit 33R corrects the luminance information JR1 so as to generate the luminance information JR. According to this, it is possible to make a circuit scale small. That is, for example, in a case of directly converting the luminance information IR to the luminance information JR on the basis of the luminance information IR, and the luminance variation rates Nwy and Nwb, it is necessary for each look-up table to store a corresponding relationship of the luminance information IR of the entire range and the luminance information JR of the entire range, and thus there is a concern that the scale of the look-up table may increase. On the other hand, in the correction unit 33R, the look-up table may store only a corresponding relationship of the luminance information IR of the entire range, and a difference (correction amount ΔJR) between the luminance information JR1 and the luminance information JR, and thus it is possible to make the scale of the look-up table small.

Similarly, the correction unit 33G obtains a correction amount ΔJG on the basis of the luminance information IG and the luminance variation rates Nwy and Nwb, and adds the correction amount ΔJG to the luminance information JG1 to generate the luminance information JG. At that time, the correction unit 33G is configured to set the correction amount ΔJG in such a manner that the luminance information JG becomes smaller than luminance information JG0 that is obtained according to the ideal conversion characteristics. Similarly, the correction unit 33B obtains a correction amount ΔJB on the basis of the luminance information IB and the luminance variation rates Nwy and Nwb, and adds the correction amount ΔJB to the luminance information JB1 to generate the luminance information JB. At that time, the correction unit 33B is configured to set the correction amount ΔJB in such a manner that the luminance information JB becomes smaller than luminance information JB0 that is obtained according to the ideal conversion characteristics.

The minimum value selecting unit 34 selects a minimum among the three pieces of luminance information JR, JG, and JB which are supplied from the correction unit 33, and outputs the selected information as a parameter Wmax. As described later, the parameter Wmax represents the maximum value among values which can be taken by the luminance information IW2.

In this manner, the reciprocal calculating unit 31, the multiplication unit 32, the correction unit 33, and the minimum value selecting unit 34 obtain the parameter Wmax for each pixel on the basis of the luminance information IR, the luminance information IG, the luminance information IB, the parameters Kr, Kg, and Kb, and the luminance variation rates Nwy and Nwb. The parameter Wmax may be expressed by the following Equation.

$$Wmax=\mathrm{Min}(IR/Kr+\Delta JR, IG/Kg+\Delta JG, IB/Kb+\Delta JB) \quad (1)$$

Here, Min represents a function of selecting the minimum one among the three parameters. In addition, the correction amount ΔJR is determined on the basis of the luminance information IR and the luminance variation rates Nwy and Nwb, the correction amount ΔJG is determined on the basis of the luminance information IG and the luminance variation rates Nwy and Nwb, and the correction amount ΔJB is determined on the basis of the luminance information IB and the luminance variation rates Nwy and Nwb.

The Gw calculating unit 35 calculates a W conversion rate Gw for each pixel Pix on the basis of the parameter Wmax. The W conversion rate Gw represents a percentage of allowing the white sub-pixel 24W to emit a light beam, and represents a value of 0 to 1 in this example. In this example, the Gw calculating unit 35 includes a look-up table, and calculates the W conversion rate Gw for each pixel Pix by using the look-up table.

Figure 8:
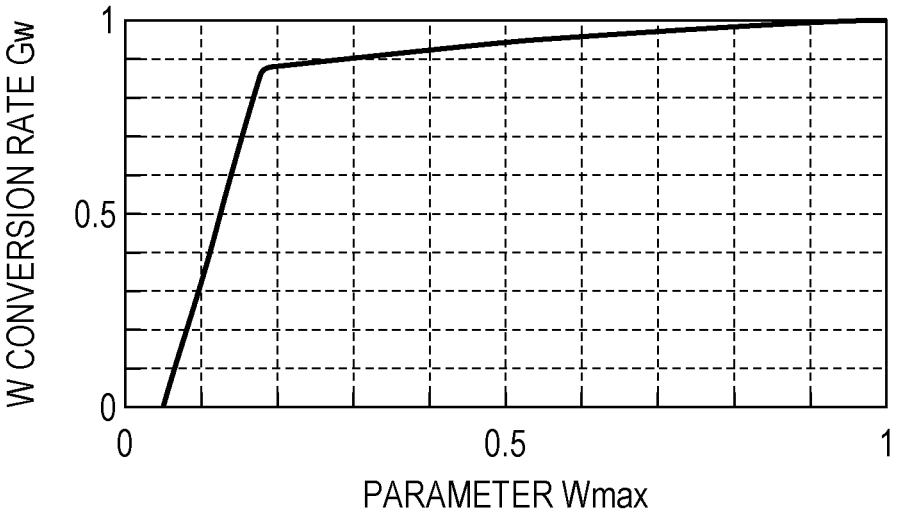
FIG. 8 is an explanatory view illustrating a characteristic example of a Gw calculating unit illustrated in FIG. 4.

FIG. 8 illustrates characteristics of the look-up table in the Gw calculating unit 35. In this example, the parameter Wmax is normalized. That is, the minimum value of the parameter Wmax is set to "0", and the maximum value of the parameter Wmax is set to "1". As described above, in the look-up table of the Gw calculating unit 35, in a case where the parameter Wmax is low, the W conversion rate Gw decreases, and in a case where the parameter Wmax is high, the W conversion rate Gw increases.

The multiplication unit 36 multiplies the parameter Wmax and the W conversion rate Gw to generate luminance information IW2. As described above, the W conversion rate Gw has a value of 0 to 1, and thus a value of the luminance information IW2 is lower than a value of the parameter Wmax. That is, the parameter Wmax represents the maximum value among values which can be taken by the luminance information IW2. The luminance information IW2 can be expressed by the following Equation.

$$IW2=Wmax\times Gw \quad (2)$$

Here, the W conversion rate Gw is determined on the basis of the parameter Wmax.

In addition, in this example, the Gw calculating unit 35 and the multiplication unit 36 are provided. However, there is no limitation thereto and these components may be omitted. In this case, the minimum value selecting unit 34 outputs the minimum one among the three pieces of luminance information JR, JG, and JB as the luminance information IW2.

The multiplication unit 37, the subtraction unit 38, and the correction unit 39 convert the luminance information IR, the luminance information IG, and the luminance information IB, which are included in the image signal Sp12, to the luminance information IR2, the luminance information IG2, and the luminance information IB2. At that time, as described later, the multiplication unit 37 multiplies the luminance information IW2 by the parameters Kr, Kg, and Kb, and then the correction unit 39 generates luminance information IR1, luminance information IG1, and luminance information IB1 on the basis of the multiplication result obtained by the multiplication unit 37 and the luminance information IR, the luminance information IG, and the luminance information IB. Then, the correction unit 39 corrects the luminance information IR1, the luminance information IG1, and the luminance information IB1, respectively. The series of operations corresponds to inverse conversion of the conversion (FIG. 5) by the multiplication unit 32 and the correction unit 33. That is, the multiplication unit 37 corresponds to the multiplication unit 32, and the correction unit 39 corresponds to the correction unit 33. As is the case with the multiplication unit 32 and the correction unit 33, the multiplication unit 37, the subtraction unit 38, and the correction unit 39 are configured to generate the luminance information IR2, the luminance information IG2, and the luminance information IB2 in two stages on the basis of the luminance information IW2.

The multiplication unit 37 multiplies the luminance information IW2 by the parameters Kr, Kg, and Kb, respectively. Specifically, the multiplication unit 37 multiplies the luminance information IW2 by the parameter Kr (IW2×Kr), multiplies the luminance information IW2 by the parameter Kg (IW2×Kg), and multiplies the luminance information IW2 by the parameter Kb (IW2×Kb).

Subtraction unit 38 subtracts one (IW2×Kr) of the multiplication results obtained by the multiplication unit 37 from the luminance information IR to generate the luminance information IR1, subtracts one (IW2×Kg) of the multiplication results obtained by the multiplication unit 37 from the luminance information IG to generate the luminance information IG1, and subtracts one (IW2×Kb) of the multiplication results obtained by the multiplication unit 37 from the luminance information IB to generate the luminance information IB1.

The correction unit 39 performs correction with respect to the luminance information IR1, the luminance information IG1, and the luminance information IB1 to generate the luminance information IR2, the luminance information IG2, and the luminance information IB2. The correction unit 39 includes correction units 39R, 39G, and 39B.

The correction unit 39R obtains a correction amount ΔIR on the basis of the luminance information IW2 and the luminance variation rates Nwy and Nwb, and adds the correction amount ΔIR to the luminance information IR1 to generate the luminance information IR2. Similarly to the correction unit 33R, the correction unit 39R includes a plurality of look-up tables which are correlated with the luminance variation rates Nwy and Nwb. Each of the look-up tables indicates a relationship between the luminance information IW2 and the correction amount ΔIR. According to this configuration, first, the correction unit 39R selects one of the plurality of look-up tables on the basis of the luminance variation rates Nwy and Nwb. Next, the correction unit 39R obtains the correction amount ΔIR by linear interpolation on the basis of the luminance information IW2 by using the look-up table that is selected. In addition, the correction unit 39R is configured to generate the luminance information IR2 by adding the correction amount ΔIR to the luminance information IR1.

According to this, the correction unit 39R sets the correction amount ΔIR in such a manner that the corrected luminance information IR2 is to be as close as possible to luminance information IR0 that is inversely converted according to the ideal conversion characteristics. That is, in the above-described correction unit 33R, as illustrated in FIG. 7, the correction amount ΔJR is set in such a manner that the luminance information JR becomes smaller than the luminance information JR0. However, in the correction unit 39R, it is not necessary for the luminance information IR2 to be smaller than the luminance information IR0, and it is desired for the luminance information IR2 to be close to the luminance information IR0.

Similarly, the correction unit 39G obtains a correction amount ΔIG on the basis of the luminance information IW2 and the luminance variation rates Nwy and Nwb, and adds the correction amount ΔIG to the luminance information IG1 to generate the luminance information IG2. In addition, the correction unit 39B obtains a correction amount ΔIB on the basis of the luminance information IW2 and the luminance variation rates Nwy and Nwb, and adds the correction amount ΔIB to the luminance information IB1 to generate the luminance information IB2.

In this manner, the multiplication unit 37, the subtraction unit 38, and the correction unit 39 obtain the luminance information IR2, the luminance information IG2, and the luminance information IB2 on the basis of the luminance information IR, the luminance information IG, the luminance information IB, the luminance information IW2, the parameters Kr, Kg, and Kb, and the luminance variation rates Nwy and Nwb. The luminance information IR2, the luminance information IG2, and the luminance information IB2 can be expressed by the following Equations.

$$IR2=IR-Kr\times IW2+\Delta IR \quad (3)$$

$$IG2=IG-Kg\times IW2+\Delta IG \quad (4)$$

$$IB2=IB-Kb\times IW2+\Delta IB \quad (5)$$

Here, the correction amount ΔIR is determined on the basis of the luminance information IW2 and the luminance variation rates Nwy and Nwb, the correction amount ΔIG is determined on the basis of the luminance information IW2 and the luminance variation rates Nwy and Nwb, and the correction amount ΔIB is determined on the basis of the luminance information IW2 and the luminance variation rates Nwy and Nwb.

In this manner the RGBW conversion unit 30 converts the luminance information IR, the luminance information IG, and the luminance information IB to the luminance information IR2, the luminance information IG2, the luminance information IB2, and the luminance information IW2. According to this, in the display device 1, for example, in a case of displaying a white color, the white sub-pixel 24W is mainly allowed to emit a light beam, and thus it is possible to reduce power consumption. Particularly, in the RGBW conversion unit 30, since the RGBW conversion is performed on the basis of the luminance variation rates Nwy and Nwb, as described later, even when light-emitting characteristics of the sub-pixel 24 vary with the passage of time, it is possible to appropriately perform the RGBW conversion, and thus it is possible to effectively reduce the power consumption.

The correction unit 40 corrects the image signal Sp13 on the basis of luminance variation rates Nr, Ng, and Nb to generate an image signal Sp14. Here, the luminance variation rate Nr indicates a variation in luminance with the passage of time regarding a red light beam that is emitted from the red (R) sub-pixel 24R. That is, the luminance variation rate Nr mainly corresponds to a variation in light-emitting characteristics with the passage of time in the yellow light-emitting layer LY of the sub-pixel 24R. Similarly, the luminance variation rate Ng indicates a variation in luminance with the passage of time regarding a green light beam that is emitted from the green (G) sub-pixel 24G. That is, the luminance variation rate Ng mainly corresponds to a variation in light-emitting characteristics with the passage of time in the yellow light-emitting layer LY of the sub-pixel 24G. In addition, the luminance variation rate Nb indicates a variation in luminance with the passage of time regarding to a green light beam that is emitted from the blue (B) sub-pixel 24B. That is, the luminance variation rate Nb mainly corresponds to a variation in light-emitting characteristics with the passage of time in the blue light-emitting layer LB of the sub-pixel 24B. As is the case with the luminance variation rates Nwy and Nwb, in the luminance variation rates Nr, Ng, and Nb, for example, an initial value thereof is "1", and the luminance variation rates Nr, Ng, and Nb decrease from the initial value with the passage of time.

Figure 9:
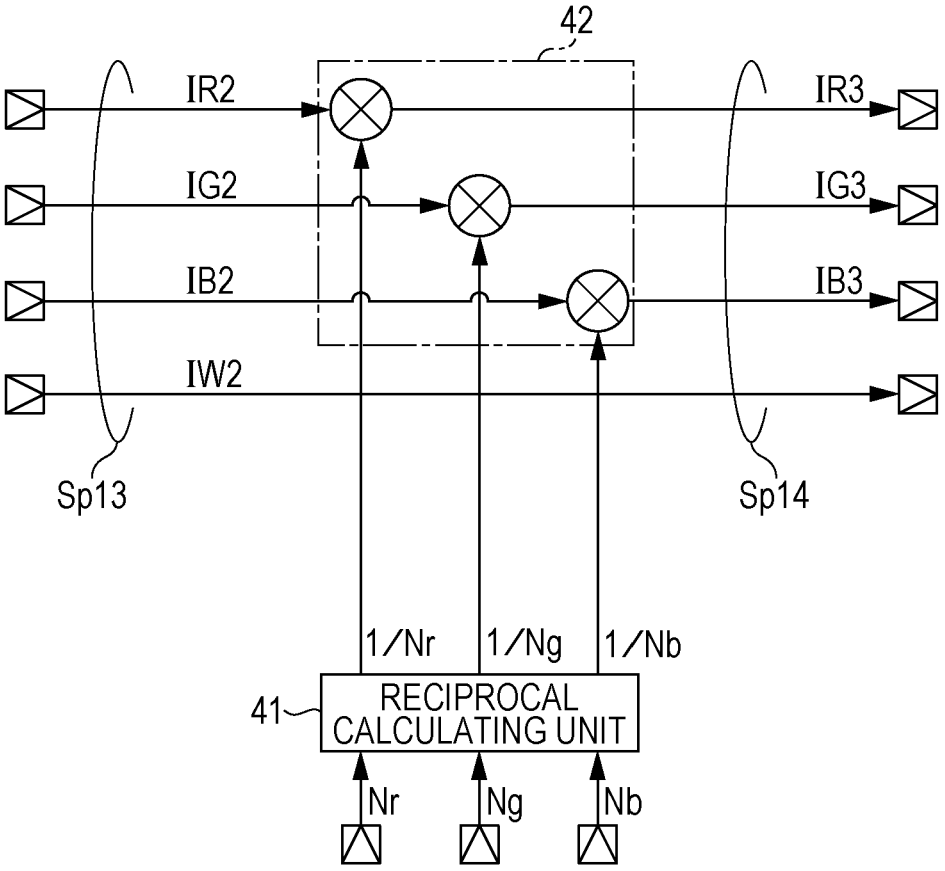
FIG. 9 is a block diagram illustrating a configuration example of the correction unit illustrated in FIG. 4.

FIG. 9 illustrates a configuration example of the correction unit 40. The correction unit 40 includes a reciprocal calculating unit 41, and a multiplication unit 42. On the basis of the luminance variation rates Nr, Ng, and Nb, the reciprocal calculating unit 41 obtains reciprocals "1/Nr", "1/Ng", and "1/Nb" thereof, respectively. The multiplication unit 42 multiplies the luminance information IR2, the luminance information IG2, and the luminance information IB2 of each pixel, which are included in the image signal Sp13, by the reciprocals "1/Nr", "1/Ng", and "1/Nb" of the luminance variation rates Nr, Ng, and Nb. Specifically, the multiplication unit 42 multiplies the luminance information IR2 by "1/Nr" to generate the luminance information IR3. The multiplication unit 42 multiplies the luminance information IG2 by "1/Ng" to generate the luminance information IG3. The multiplication unit 42 multiplies the luminance information IB2 by "1/Nb" to generate the luminance information IB3. In addition, the correction unit 40 is configured to output the luminance information IR3, the luminance information IG3, and the luminance information IB3 as an image signal Sp14 in combination with the luminance information IW2.

As described above, the correction unit 40 multiplies the luminance information IR2 by "1/Nr" in accordance with a variation (luminance variation rate Nr) in light-emitting characteristics with the passage of time in the red sub-pixel 24R. The correction unit 40 multiplies the luminance information IG2 by "1/Ng" in accordance with a variation (luminance variation rate Ng) in light-emitting characteristics with the passage of time in the green sub-pixel 24G. The correction unit 40 multiplies the luminance information IB2 by "1/Nb" in accordance with a variation (luminance variation rate Nb) in light-emitting characteristics with the passage of time in the blue sub-pixel 24B. According to this, the correction unit 40 compensates for a decrement in luminance of the sub-pixels 24R, 24G, and 24B with the passage of time, and as a result, it is possible to improve the image quality.

The luminance variation rate calculating unit 15 generates the luminance variation rates Nwy, Nwb, Nr, Ng, and Nb on the basis of the pixel signal Sp14 and the temperature signal Stemp. The luminance variation rate calculating unit 15 includes a memory 19. For example, the memory 19 stores the luminance variation rates Nwy, Nwb, Nr, Ng, and Nb in each pixel Pix of the EL display unit 22.

In addition, the luminance variation rate calculating unit 15 includes a look-up table that shows, for example, information for a variation in luminance with the passage of time in the yellow light-emitting layer LY and the blue light-emitting layer LB. The look-up table is configured to obtain a luminance variation rate in the yellow light-emitting layer LY and the blue light-emitting layer LB on the basis of the luminance information, the panel temperature and the light-emission time.

According to this configuration, the luminance variation rate calculating unit 15 obtains the luminance variation rate in the yellow light-emitting layer LY and the blue light-emitting layer LB of the sub-pixel 24 with a predetermined time interval on the basis of the luminance information IR3, the luminance information IG3, the luminance information IB3, the luminance information IW2, the panel temperature indicated by the temperature signal Stemp, and the light-emission time. In addition, the luminance variation rate calculating unit 15 updates the luminance variation rates Nwy, Nwb, Nr, Ng, and Nb which are stored in the memory 19 on the basis of the luminance variation rates Nwy, Nwb, Nr, Ng, and Nb which are stored in the memory 19. That is, luminance variation rate calculating unit 15 is configured to accumulate the luminance variation rate on a time axis so as to obtain the luminance variation rates Nwy, Nwb, Nr, Ng, and Nb in each pixel Pix.

In addition, in this example, the luminance variation rate calculating unit 15 obtains a set of luminance variation rates Nwy, Nwb, Nr, Ng, and Nb with respect to one pixel Pix, but there is no limitation thereto. For example, the luminance variation rate calculating unit 15 may obtain a set of luminance variation rates Nwy, Nwb, Nr, Ng, and Nb with respect to a predetermined number of pixels Pix, or may obtain a set of luminance variation rates Nwy, Nwb, Nr, Ng, and Nb with respect to the total pixels Pix of the EL display unit 22.

The panel gamma conversion unit 17 converts the image signal Sp14 having linear gamma characteristics to the image signal Sp1 having non-linear gamma characteristics corresponding to characteristics of the EL display unit 22 (panel gamma conversion). As is the case with the linear gamma conversion unit 11, for example, the panel gamma conversion unit 17 includes a look-up table, and is configured to perform the gamma conversion by using the look-up table.

Here, the RGBW conversion unit 30 corresponds to a specific example of a "luminance information generating unit" in the present disclosure. The EL display unit 22 corresponds to a specific example of a "display unit" in the present disclosure. Each of the sub-pixels 24R, 24G, and 24B corresponds to a specific example of each of a "first pixel", a "second pixel", and a "third pixel" in the present disclosure, and the sub-pixel 24W corresponds to a specific example of a "fourth pixel" in the present disclosure. Each of the luminance information IR, the luminance information IG, and the luminance information IB corresponds to a specific example of each of "first luminance information", "second luminance information", and "third luminance information" in the present disclosure, and the luminance information IW2 corresponds to a specific example of "fourth luminance information" in the present disclosure. Each of the luminance variation rates Nwy and Nwb corresponds to a specific example of a "variation characteristic with the passage of time" in the present disclosure. The luminance variation rate calculating unit 15 corresponds to a specific example of an "operation unit" in the present disclosure. Each of the parameters Kr, Kg, and Kb corresponds to a specific example of a "first parameter", a "second parameter", and a "third parameter" in the present disclosure. The correction unit 40 corresponds to a specific example of a "correction unit" in the present disclosure.

Operation and Function

Continuously, an operation and a function of the display device 1 according to this embodiment will be described.

Summary of Overall Operations

First, a summary of overall operations of the display device 1 will be described with reference to FIG. 1. The linear gamma conversion unit 11 converts the image signal Sp0, which is input, to the image signal Sp11 having linear gamma characteristics (linear gamma conversion). The signal processing unit 12 performs a predetermined task of signal processing with respect to the image signal Sp11, and outputs the result as the image signal Sp12. The parameter calculating unit 16 obtains the parameters Kr, Kg, and Kb on the basis of the luminance variation rates Nwy and Nwb. The RGBW conversion unit 30 generates an RGBW signal on the basis of the image signal Sp12 that is an RGB signal, the parameters Kr, Kg, and Kb, and the luminance variation rates Nwy and Nwb, and outputs the RGBW signal as the image signal Sp13. The correction unit 40 corrects the image signal Sp13 on the basis of the luminance variation rates Nr, Ng, and Nb to generate the image signal Sp14. The luminance variation rate calculating unit 15 generates the luminance variation rates Nwy, Nwb, Nr, Ng, and Nb on the basis of the pixel signal Sp14 and the temperature signal Stemp. The panel gamma conversion unit 17 converts the image signal Sp14 having linear gamma characteristics to the image signal Sp1 having non-linear gamma characteristics corresponding to characteristics of the EL display unit 22 (panel gamma conversion). The display control unit 21 performs timing control of a display operation in the EL display unit 22 on the basis of the image signal Sp1. The EL display unit 22 performs a display operation on the basis of the control by the display control unit 21. The temperature sensor 23 detects a temperature (panel temperature) in the EL display unit 22, and outputs the detection result as the temperature signal Stemp.

Detailed Operation of RGBW Conversion Unit 30

In the RGBW conversion unit 30, first, the multiplication unit 32 multiplies the luminance information IR by the reciprocal "1/Kr" of the parameter Kr to generate the luminance information JR1. The RGBW conversion unit 30 multiplies the luminance information IG by the reciprocal "1/Kg" of the parameter Kg to generate the luminance information JG1. The RGBW conversion unit 30 multiplies the luminance information IB by the reciprocal "1/Kb" of the parameter Kb to generate the luminance information JB1. In addition, the correction unit 33 performs correction with respect to the luminance information JR1, the luminance information JG1, and the luminance information JB1 to generate the luminance information JR, the luminance information JG, and the luminance information JB, respectively. The minimum value selecting unit 34 selects the minimum one among the three pieces of luminance information JR, JG, and JB, and outputs the selected luminance information as the parameter Wmax. The Gw calculating unit 35 calculates the W conversion rate Gw on the basis of the parameter Wmax. The multiplication unit 36 multiplies the parameter Wmax and the W conversion rate Gw to generate the luminance information IW2. The multiplication unit 37 multiplies the luminance information IW2 by each of the parameters Kr, Kg, and Kb. The subtraction unit 38 subtracts (IW2×Kr) from the luminance information IR to generate the luminance information IR1. The subtraction unit 38 subtracts (IW2×Kg) from the luminance information IG to generate the luminance information IG1. The subtraction unit 38 subtracts (IW2×Kb) from the luminance information IB to generate the luminance information IB1. In addition, the correction unit 39 performs correction with respect to the luminance information IR1, the luminance information IG1, and the luminance information IB1 to generate the luminance information IR2, the luminance information IG2, and the luminance information IB2, respectively.

Figure 10:
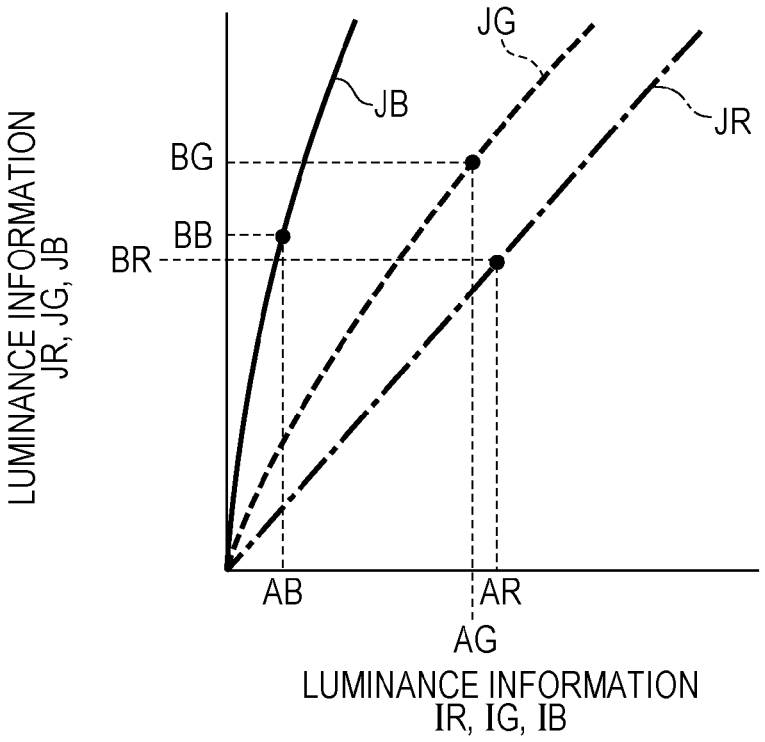
FIG. 10 is an explanatory view illustrating an operation example of the RGBW conversion unit illustrated in FIG. 4.

FIG. 10 illustrates a conversion operation in the multiplication unit 32 and the correction unit 33. In this example, values of the luminance information IR, the luminance information IG, and the luminance information IB, which are input, are AR, AG, and AB. As illustrated in FIG. 10, the multiplication unit 32 and the correction unit 33 converts the value AR (luminance information IR) to a value BR (luminance information JR), converts the value AG (luminance information IG) to a value BG (luminance information JG), and converts the value AB (luminance information IB) to a value BB (luminance information JB), respectively.

The minimum value selecting unit 34 selects the minimum one (in this example, the value BR) among the values BR, BG, and BB of the luminance information JR, the luminance information JG, and the luminance information JB as the parameter Wmax. In addition, the Gw calculating unit 35 obtains the W conversion rate Gw on the basis of the parameter Wmax (the value BR), and the multiplication unit 36 multiplies the parameter Wmax (value BR) and the W conversion rate Gw to generate the luminance information IW2. In addition, the multiplication unit 37, the subtraction unit 38, and the correction unit 39 obtain the luminance information IR2, the luminance information IG2, and the luminance information IB2 on the basis of the luminance information IW2, the luminance information IR, the luminance information IG, and the luminance information IB.

Figure 11:
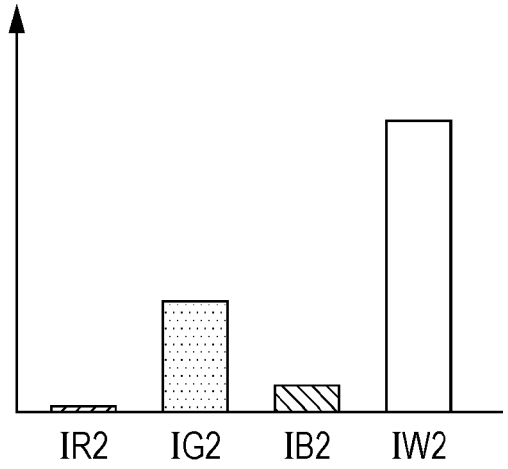
FIG. 11 is another explanatory view illustrating an operation example of the RGBW conversion unit illustrated in FIG. 4.

FIG. 11 illustrates the luminance information IR2, the luminance information IG2, the luminance information IB2, and the luminance information IW2 when the luminance information IR, the luminance information IG, and the luminance information IB are the values AR, AG, and AB, respectively. As illustrated in FIG. 10, in this example, since the values BR, BG, and BB of the luminance information JR, the luminance information JG, and the luminance information JB are relatively large values, the value (value BR) of the parameter Wmax, which is the minimum value among the values, also becomes a large value. Accordingly, as illustrated in FIG. 11, the luminance information IW2 relating to the white sub-pixel 24W increases. That is, in this case, it is possible to mainly allow the white sub-pixel 24W to emit a light beam, and thus it is possible to reduce the power consumption.

As described above, the display device 1 is configured in such a manner that conversion characteristics from the luminance information IR, the luminance information IG, and the luminance information IB to the luminance information JR, the luminance information JG, and the luminance information JB vary in accordance with a variation in light-emitting characteristics with the passage of time in the sub-pixel 24W. According to this, in the display device 1, it is possible to appropriately perform the RGBW conversion in accordance with the variation in the light-emitting characteristics with the passage of time in the sub-pixel 24W, and thus it is possible to reduce the power consumption in comparison to a case where the conversion characteristics do not vary similar to a display device 1R according to a comparative example to be described later.

In addition, in the correction unit 33, as illustrated in FIG. 7, the correction amounts ΔJR, ΔJG, and ΔJB are set in such a manner that the luminance information JR, the luminance information JG, and the luminance information JB become smaller than the luminance information JR0, JG0, and JB0 which are converted according to the ideal conversion characteristics. According to this, it is possible to reduce a concern about a decrease in an image quality. That is, in the example in FIG. 10, if the value BR of the luminance information JR is larger than the luminance information JR0, the luminance information IW2 also increases to that extent. In this case, for example, the multiplication result ((IW2×Kr) obtained by the multiplication unit 37 becomes larger than the value of the luminance information IR, and thus it is difficult for the subtraction unit 38 to accurately perform subtraction. As a result, there is a concern of a decrease in the image quality. On the other hand, in the display device 1, the correction amount ΔJR is set in such a manner that the luminance information JR becomes smaller than the luminance information JR0 that is converted according to the ideal conversion characteristics. As a result, it is possible to reduce the concern that the subtraction unit 38 does not accurately perform subtraction, and thus it is possible to reduce the concern about the decrease in the image quality.

Comparative Example

Next, the display device 1R according to the comparative example will be described. The display device 1R does not consider the variation in the light-emitting characteristics with the passage of time in the sub-pixel 24W during the RGBW conversion.

Figure 12:
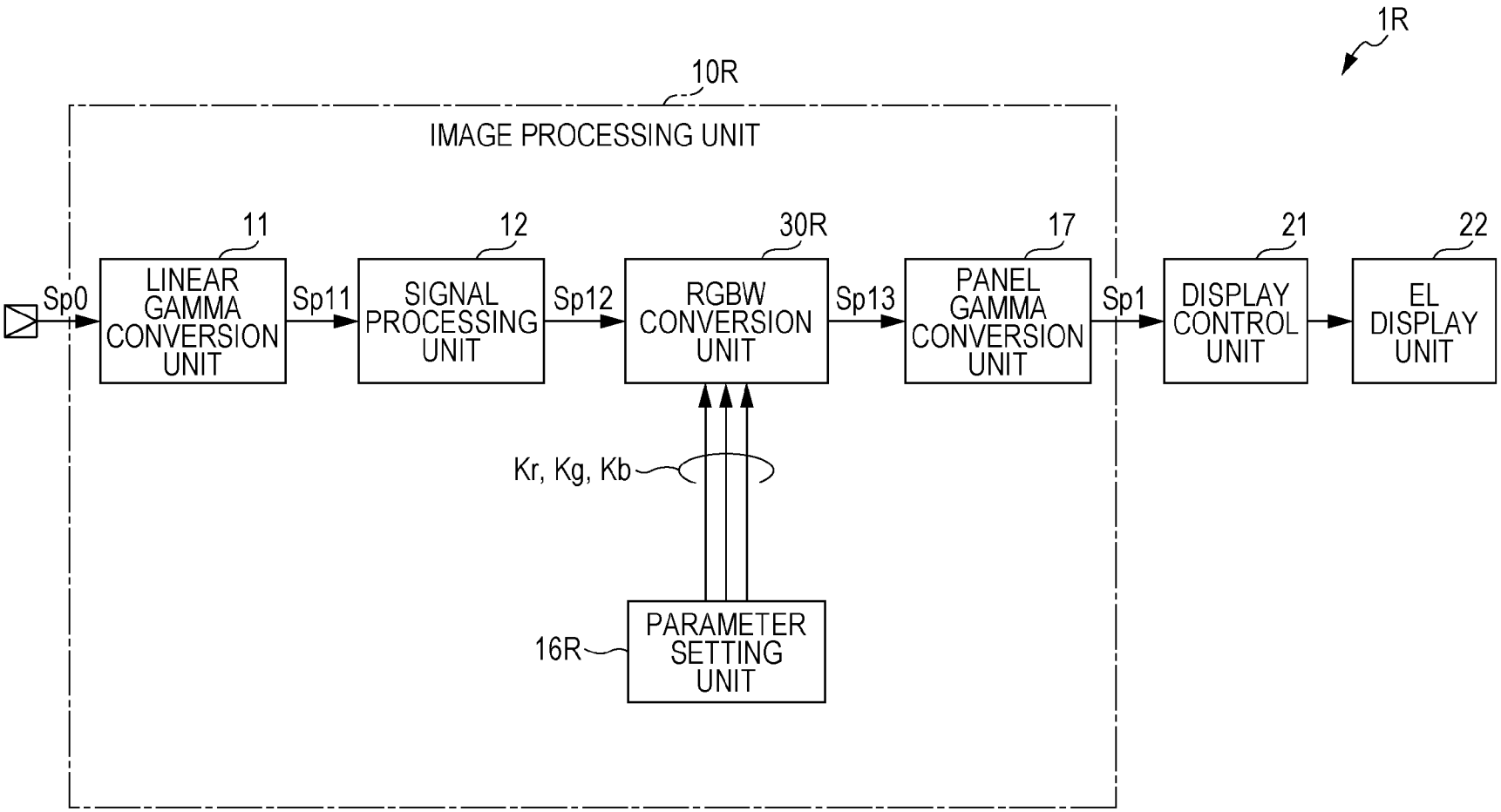
FIG. 12 is a block diagram illustrating a configuration example of a display device according to a comparative example.

FIG. 12 illustrates a configuration example of the display device 1R. The display device 1R includes an image processing unit 10R. The image processing unit 10R includes a linear gamma conversion unit 11, a signal processing unit 12, a parameter setting unit 16R, an RGBW conversion unit 30R, and a panel gamma conversion unit 17. The parameter setting unit 16R supplies parameters Kr, Kg, and Kb to the RGBW conversion unit 30R. In this comparative example, the parameters Kr, Kg, and Kb are constants, and are obtained from light-emitting characteristics of the sub-pixel 24W before variation with the passage of time. The RGBW conversion unit 30R generates an RGBW signal on the basis of an image signal Sp12 that is an RGB signal, and the parameters Kr, Kg, and Kb, and outputs the RGBW signal as an image signal Sp13. In addition, the RGBW conversion unit 30R is configured to supply the image signal Sp13 to the panel gamma conversion unit 17. That is, the display device 1R has a configuration in which the correction unit 40, the luminance variation rate calculating unit 15, and the temperature sensor 23 are omitted from the configuration of the display device 1 (FIG. 1) according to this embodiment, the parameter calculating unit 16 is substituted with the parameter setting unit 16R, and the RGBW conversion unit 30 is substituted with the RGBW conversion unit 30R.

Figure 13:
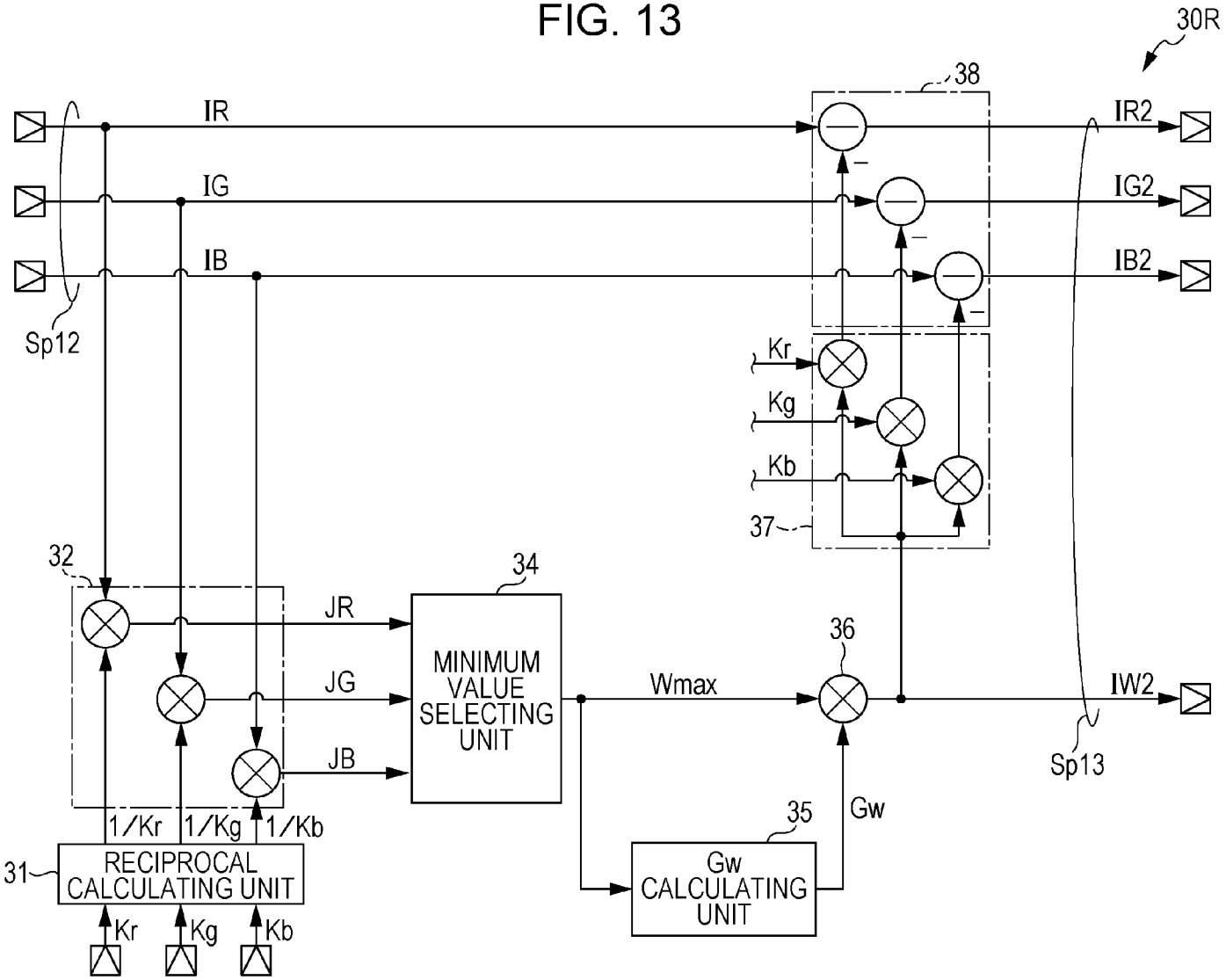
FIG. 13 is a block diagram illustrating a configuration example of an RGBW conversion unit illustrated in FIG. 12.

FIG. 13 illustrates a configuration example of the RGBW conversion unit 30R. The RGBW conversion unit 30R includes a reciprocal calculating unit 31, a multiplication unit 32, a minimum value selecting unit 34, a Gw calculating unit 35, multiplication units 36 and 37, and a substraction unit 38. The multiplication unit 32 multiplies luminance information IR by "1/Kr" to generate luminance information JR. The multiplication unit 32 multiplies luminance information IG by "1/Kg" to generate luminance information JG. The multiplication unit 32 multiplies luminance information IB by a constant "1/Kb" to generate luminance information JB. The multiplication unit 32 supplies the luminance information JR, the luminance information JG, and the luminance information JB to the minimum value selecting unit 34. The subtraction unit 38 subtracts one (IW2×Kr) of multiplication results obtained by the multiplication unit 37 from the luminance information IR to generate luminance information IR2, subtracts one (IW2×Kg) of the multiplication results obtained by the multiplication unit 37 from the luminance information IG to generate luminance information IG2, and subtracts one (IW2×Kb) of the multiplication results obtained by the multiplication unit 37 from the luminance information IB to generate luminance information IB2. The subtraction unit 38 supplies the luminance information IR2, the luminance information IG2, and the luminance information IB2 to the panel gamma conversion unit 17. That is, the RGBW conversion unit 30R has a configuration in which the correction units 33 and 39 are omitted from the RGBW conversion unit 30 (FIG. 4) according to this embodiment.

In the RGBW conversion unit 30R, the multiplication unit 32 converts the luminance information IR, the luminance information IG, and the luminance information IB to the luminance information JR, the luminance information JG, and the luminance information JB through linear conversion by using the parameters Kr, Kg, and Kb which are constants obtained from the light-emitting characteristics of the sub-pixel 24W before variation with the passage of time. That is, in the RGBW conversion unit 30 according to this embodiment, the conversion characteristics are changed in accordance with the variation in the light-emitting characteristics of the sub-pixel 24W with the passage of time, but in the RGBW conversion unit 30R according to the comparative example, even when the light-emitting characteristics vary with the passage of time in the sub-pixel 24W, the conversion characteristics are retained.

Figure 14:
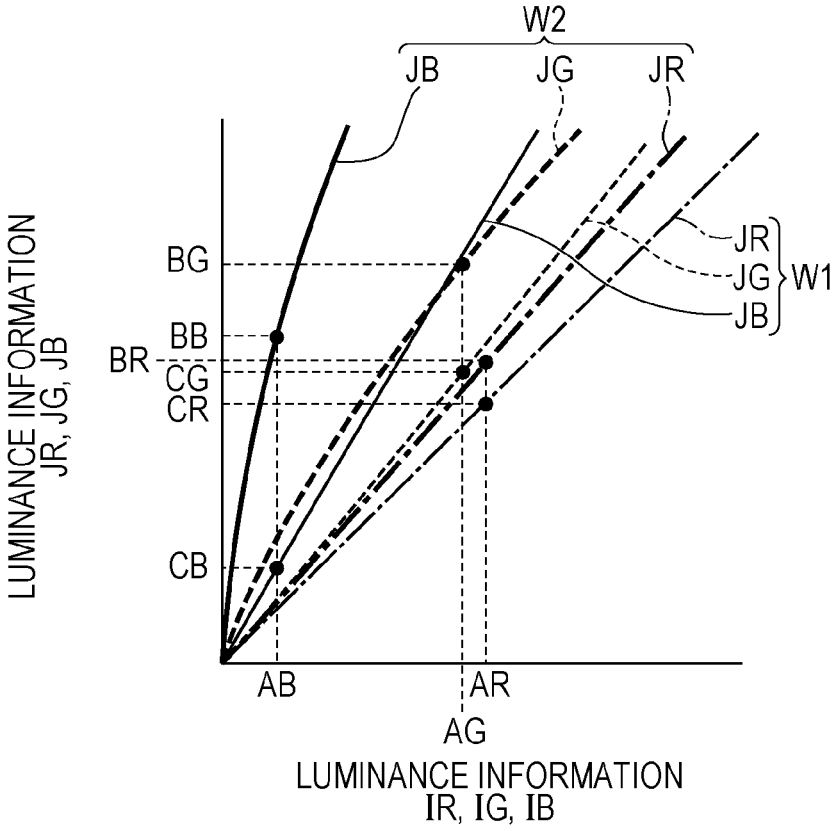
FIG. 14 is an explanatory view illustrating an operation example of the RGBW conversion unit illustrated in FIG. 13.

FIG. 14 illustrates conversion characteristics W1 from the luminance information IR, the luminance information IG, and the luminance information IB to the luminance information JR, the luminance information JG, and the luminance information JB. In FIG. 14, conversion characteristics (conversion characteristics W2) illustrated in FIG. 10 are illustrated in combination. Here, it is assumed that the conversion characteristics W2 are characteristics in a case where the light-emitting characteristics of the sub-pixel 24W vary with the passage of time. The multiplication unit 32 and the correction unit 33 convert a value AR (luminance information IR) to a value CR (luminance information JR), convert a value AG (luminance information IG) to a value CG (luminance information JG), and convert a value AB (luminance information IB) to a value CB (luminance information JB). In this example, the values CR, CG, and CB of the luminance information JR, the luminance information JG, and the luminance information JB are set to be smaller than values BR, BG, and BB which are converted according to the conversion characteristics W2.

Figure 15:
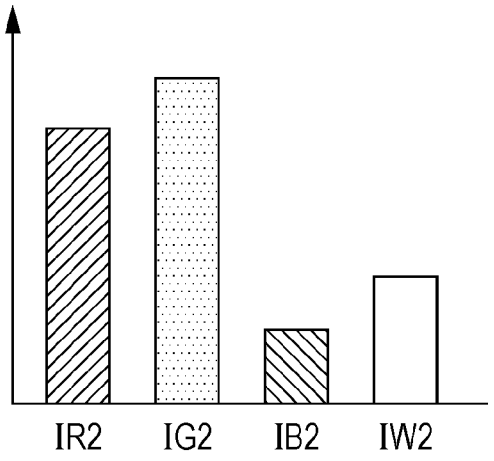
FIG. 15 is another explanatory view illustrating an operation example of the RGBW conversion unit illustrated in FIG. 13.

FIG. 15 illustrates the luminance information IR2, the luminance information IG2, the luminance information IB2, and the luminance information IW2 when the luminance information IR, the luminance information IG, and the luminance information IB are the values AR, AG, and AB. As illustrated in FIG. 14, in this example, the value CB of the luminance information JB is slightly small, and thus a value of the parameter Wmax (value CB) also decreases. Accordingly, the luminance information IW2 relating to the white sub-pixel 24W decreases. That is, in this case, since contribution of the white sub-pixel 24W in the pixel Pix is small, there is a concern that the power consumption may increase.

As described above, in the RGBW conversion unit 30R according to the comparative example, even when the light-emitting characteristics of the sub-pixel 24W vary with the passage of time, conversion characteristics are retained. Accordingly, as illustrated in FIGS. 14 and 15, the values CR, CG, and CB of the luminance information JR, the luminance information JG, and the luminance information JB do not reflect the variation in the light-emitting characteristics with the passage of time. Accordingly, in the RGBW conversion unit 30R, in a case where the light-emitting characteristics of the sub-pixel 24W vary with the passage of time, there is a concern that the RGBW conversion may not be appropriately performed, and thus the power consumption may increase.

On the other hand, in the RGBW conversion unit 30 according to this embodiment, since the conversion characteristics are set to vary in accordance with the variation in the light-emitting characteristics with the passage of time in the sub-pixel 24W, as illustrated in FIGS. 10 and 11, the values BR, BG, and BB of the luminance information JR, the luminance information JG, and the luminance information JB reflect the variation in the light-emitting characteristics with the passage of time. Accordingly, in the RGBW conversion unit 30, even when the light-emitting characteristics of the sub-pixel 24W vary with the passage of time, it is possible to appropriately perform the RGBW conversion, and thus it is possible to effectively reduce the power consumption.

Effect

As described above, in this embodiment, since the RGBW conversion is performed in accordance with the variation in the light-emitting characteristics with the passage of time in the sub-pixel, it is possible to effectively reduce the power consumption.

In this embodiment, in the multiplication unit 32 and the correction unit 33, the luminance information IR, the luminance information IG, and the luminance information IB are converted to the luminance information JR, the luminance information JG, and the luminance information JB in two stages. In the multiplication unit 37, the subtraction unit 38, and the correction unit 39, the luminance information IR2, the luminance information IG2, the luminance information IB2 are generated in two stages on the basis of the luminance information IW2, and thus it is possible to make a circuit scale small.

According to this embodiment, in the correction unit 33, since the correction amounts ΔJR, ΔJG, and ΔJB are set in such a manner that the luminance information JR, the luminance information JG, and the luminance information JB become smaller than the luminance information JR0, the luminance information JG0, and the luminance information JB0 which are converted according to the ideal conversion characteristics, it is possible to reduce a concern about the decrease in the image quality.

In this embodiment, in the correction unit 40, since the luminance information IR2, the luminance information IG2, and the luminance information IB2 are corrected on the basis of the luminance variation rates Nr, Ng, and Nb, it is possible to increase the image quality.

Modification Example 1-1

Figure 16:
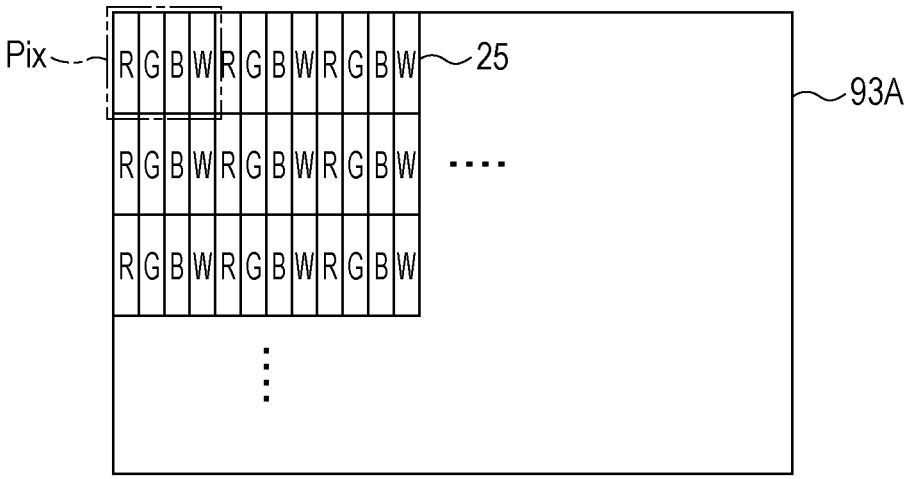
FIG. 16 is an explanatory view illustrating a configuration example of a pixel array unit according to a modification example of the first embodiment.

In the above-described embodiment, the four sub-pixels 24 in the pixel Pix are arranged in two rows and two columns, but there is no limitation thereto. Instead of this arrangement, for example, similar to a pixel array unit 93A illustrated in FIG. 16, four sub-pixels 25, which extend in a vertical direction (longitudinal direction), may be arranged in parallel with each other in a horizontal direction (lateral direction). In the pixel array unit 93A, red (R), green (G), blue (B), white (W) sub-pixels 25 are sequentially arranged from the left side in the pixel Pix.

Modification Example 1-2

In the above-described embodiment, the white light-emitting layer LW is constructed by laminating the blue light-emitting layer LB, and the yellow light-emitting layer LY, but there is no limitation thereto. Instead of this configuration, for example, the white light-emitting layer LW may be constructed by laminating a red light-emitting layer LR, a green light-emitting layer LG, and the blue light-emitting layer LB. Hereinafter, a display device 1B according to this modification example will be described in detail.

Figure 17:
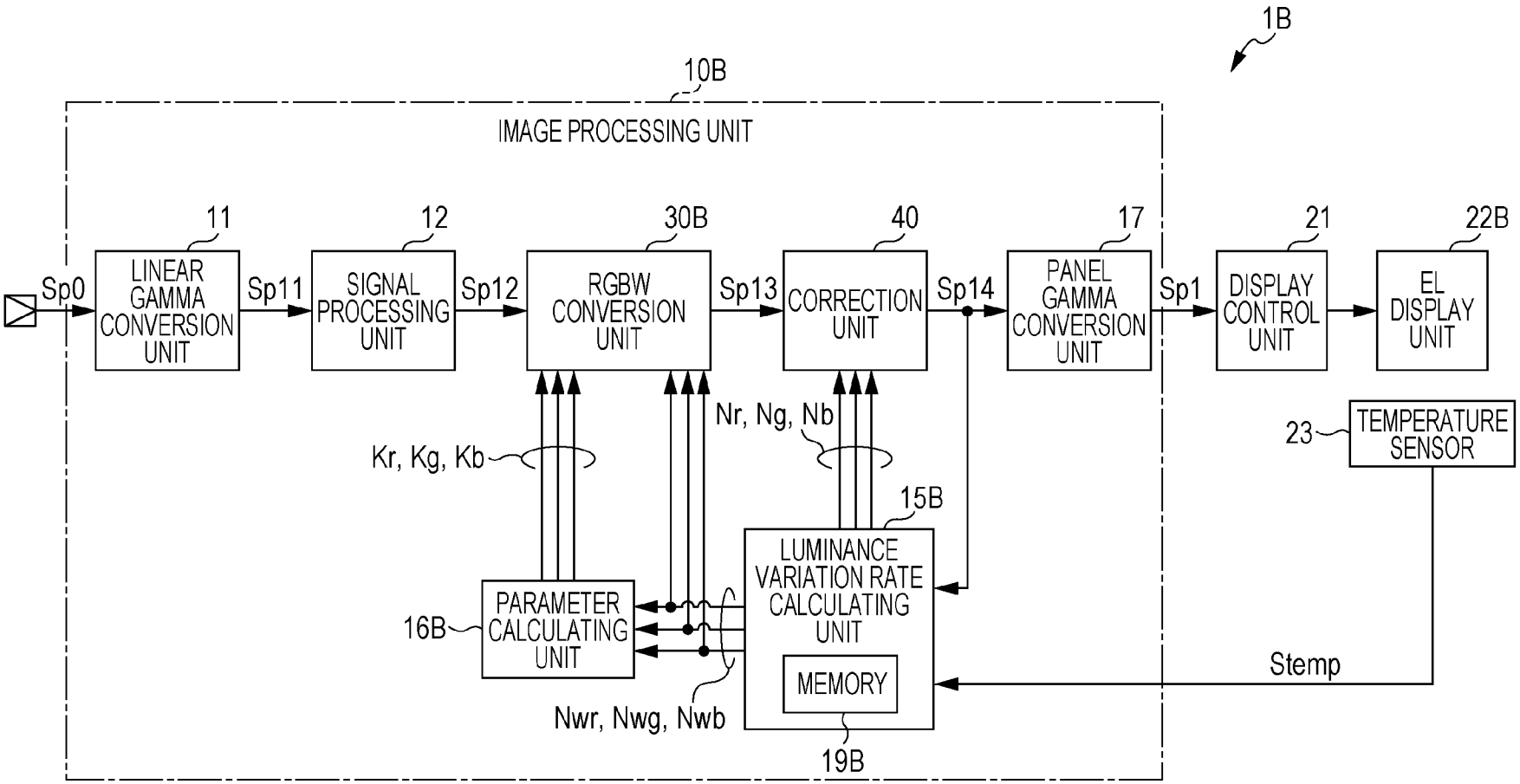
FIG. 17 is a block diagram illustrating a configuration example of a display device according to another modification example of the first embodiment.

FIG. 17 illustrates a configuration example of the display device 1B. The display device 1B includes an EL display unit 22B and an image processing unit 10B.

Figure 18:
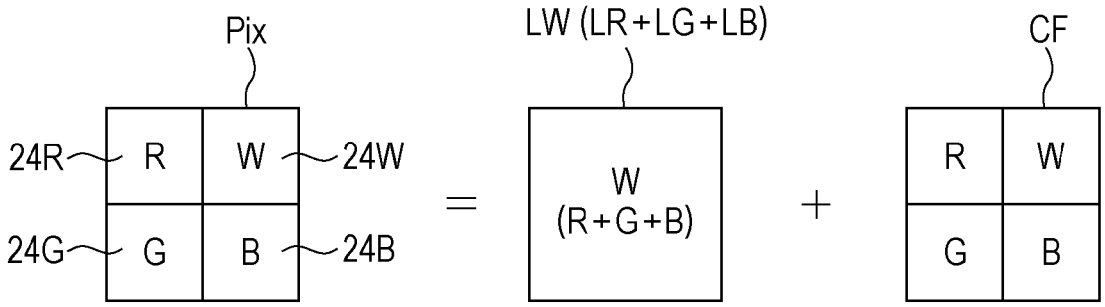
FIG. 18 is a schematic view illustrating a configuration example of a pixel in an EL display unit illustrated in FIG. 17.

FIG. 18 schematically illustrates a configuration example of a pixel Pix according to the EL display unit 22B. A white light-emitting layer LW of a pixel array unit 93B according to the EL display unit 22B is constructed by laminating an organic EL layer (red light-emitting layer LR) that emits a red (R) light beam, an organic EL layer (green light-emitting layer LG) that emits a green (G) light beam, and an organic EL layer (blue light-emitting layer LB) that emits a blue (B) light beam. In addition, the red light beam that is emitted from the red light-emitting layer LR, the green light beam that is emitted from the green light-emitting layer LG, and the blue light beam that is emitted from the blue light-emitting layer LB are mixed with each other, and the resultant mixed light beam is emitted from the white light-emitting layer LW as a white light beam.

The image processing unit 10B includes a luminance variation rate calculating unit 15B, a parameter calculating unit 16B, and an RGBW conversion unit 30B.

The luminance variation rate calculating unit 15B generates luminance variation rates Nwr, Nwg, Nwb, Nr, Ng, and Nb on the basis of a pixel signal Sp14 and a temperature signal Stemp. The luminance variation rate calculating unit 15B includes a memory 19B. For example, the memory 19B stores the luminance variation rates Nwr, Nwg, Nwb, Nr, Ng, and Nb in each pixel Pix of the EL display unit 22B. The luminance variation rate Nwr indicates a variation in luminance with the passage of time regarding a red color component in a white light beam that is emitted from the sub-pixel 24W. The luminance variation rate Nwg indicates a variation in luminance with the passage of time regarding a green color component in the white light beam that is emitted from the sub-pixel 24W. The luminance variation rate Nwb indicates a variation in luminance with the passage of time regarding a blue color component in the white light beam that is emitted from the sub-pixel 24W. That is, the luminance variation rate Nwr mainly corresponds to a variation in light-emitting characteristics with the passage of time in the red light-emitting layer LR of the sub-pixel 24W. The luminance variation rate Nwg mainly corresponds to a variation in light-emitting characteristics with the passage of time in the green light-emitting layer LG of the sub-pixel 24W. The luminance variation rate Nwb mainly corresponds to a variation in light-emitting characteristics with the passage of time in the blue light-emitting layer LB of the sub-pixel 24W. The luminance variation rate calculating unit 15B includes a look-up table that shows, for example, information for a variation in luminance with passage of time in the red light-emitting layer LR, the green light-emitting layer LG, and the blue light-emitting layer LB. The look-up table is configured to obtain a luminance variation rate in the red light-emitting layer LR, the green light-emitting layer LG, and the blue light-emitting layer LB on the basis of the luminance information, the panel temperature, and the light-emission time. According to this configuration, as is the case with the luminance variation rate calculating unit 15 according to the first embodiment, the luminance variation rate calculating unit 15B is configured to accumulate the luminance variation rate on a time axis so as to obtain the luminance variation rates Nwr, Nwg, Nwb, Nr, Ng, and Nb in each pixel Pix.

As is the case with the parameter calculating unit 16 according to the first embodiment, the parameter calculating unit 16B obtains parameters Kr, Kg, and Kb on the basis of the luminance variation rates Nwr, Nwg and Nwb.

The RGBW conversion unit 30B generates an RGBW signal on the basis of an image signal Sp12 that is an RGB signal, the parameters Kr, Kg, and Kb, and the luminance variation rates Nwr, Nwg, and Nwb, and outputs the RGBW signal as an image signal Sp13.

Figure 19:
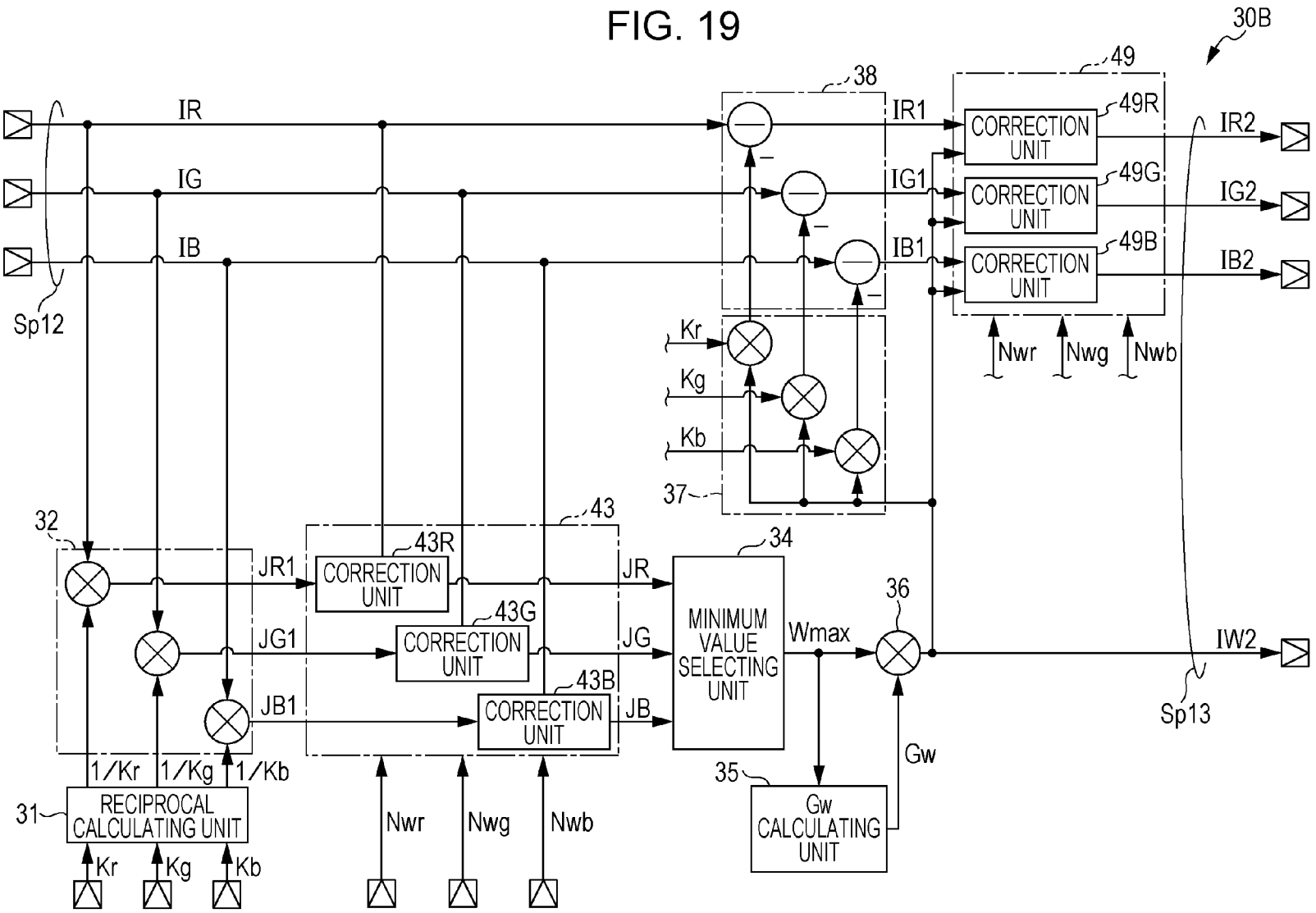
FIG. 19 is a block diagram illustrating a configuration example of an RGBW conversion unit illustrated in FIG. 17.

FIG. 19 illustrates a configuration example of the RGBW conversion unit 30B. The RGBW conversion unit 30B includes correction units 43 and 49. The correction unit 43 includes correction units 43R, 43G, and 43B. As is the case with the correction unit 33R according to the first embodiment, the correction unit 43R obtains a correction amount ΔJR on the basis of the luminance information IR and the luminance variation rates Nwr, Nwg, and Nwb, and adds the correction amount ΔJR to luminance information JR1 to generate luminance information JR. As is the case with the correction unit 33G according to the first embodiment, the correction unit 43G obtains a correction amount ΔJG on the basis of the luminance information IG and the luminance variation rates Nwr, Nwg, and Nwb, and adds the correction amount ΔJG to luminance information JG1 to generate luminance information JG. As is the case with the correction unit 33B according to the first embodiment, the correction unit 43B obtains a correction amount ΔJB on the basis of the luminance information IB and the luminance variation rates Nwr, Nwg, and Nwb, and adds the correction amount ΔJB to luminance information JB1 to generate luminance information JB. The correction unit 49 includes correction units 49R, 49G, and 49B. As is the case with the correction unit 39R according to the first embodiment, the correction unit 49R obtains a correction amount ΔIR on the basis of the luminance information IW2 and the luminance variation rates Nwr, Nwg, and Nwb, and adds the correction amount ΔIR to luminance information IR1 to generate luminance information IR2. As is the case with the correction unit 39G according to the first embodiment, the correction unit 49G obtains a correction amount ΔIG on the basis of the luminance information IW2 and the luminance variation rates Nwr, Nwg, and Nwb, and adds the correction amount ΔIG to luminance information IG1 to generate luminance information IG2. As is the case with the correction unit 39B according to the first embodiment, the correction unit 49B obtains a correction amount ΔIB on the basis of the luminance information IW2 and the luminance variation rates Nwr, Nwg, and Nwb, and adds the correction amount ΔIB to luminance information IB1 to generate luminance information IB2.

With this configuration, it is also possible to obtain the same effect as in the display device 1 according to the first embodiment.

Modification Example 1-3

Figure 20:
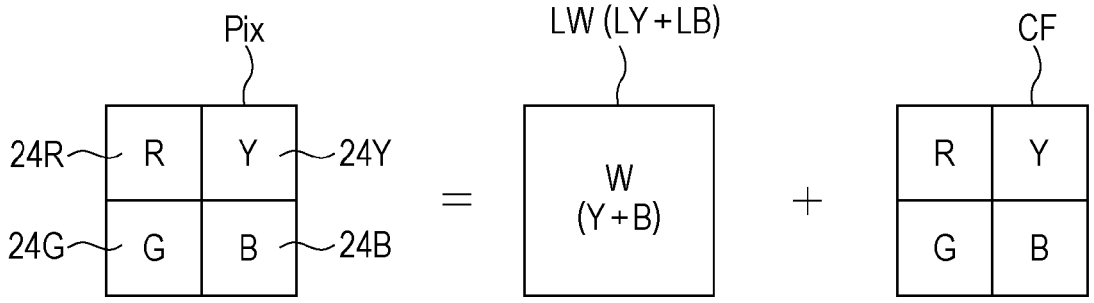
FIG. 20 is a schematic view illustrating a configuration example of a pixel according to still another modification example of the first embodiment.

In the above-described embodiment, the pixel Pix is constructed by using the white (W) sub-pixel 24W, but there is no limitation thereto. The pixel Pix may be constructed by using a sub-pixel relating to another color having high visual sensitivity similar to a white color. More specifically, it is preferable to use a sub-pixel relating to a color having high visual sensitivity that is equal to or higher than visual sensitivity of a green color having the highest visual sensitivity among a red color, a green color, and a blue color. FIG. 20 illustrates an example of a case where a yellow (Y) sub-pixel 24Y is used instead of the sub-pixel 24W. In the yellow sub-pixel 24Y, a yellow color component is separated from a white light beam by a yellow color filter CF, and is emitted.

Other Modification Examples

In addition, two or more of the modification examples may be combined.

2. Second Embodiment

Next, a display device 2 according to a second embodiment will be described. The display device 2 is configured to perform image processing in consideration of temperature dependency of the light-emitting characteristics in addition to the variation in the light-emitting characteristics with the passage of time in the organic EL layer. In addition, the same reference numerals are given to substantially the same constituent portions as in the display device 1 according to the first embodiment, and description thereof will be appropriately omitted.

Figure 21:
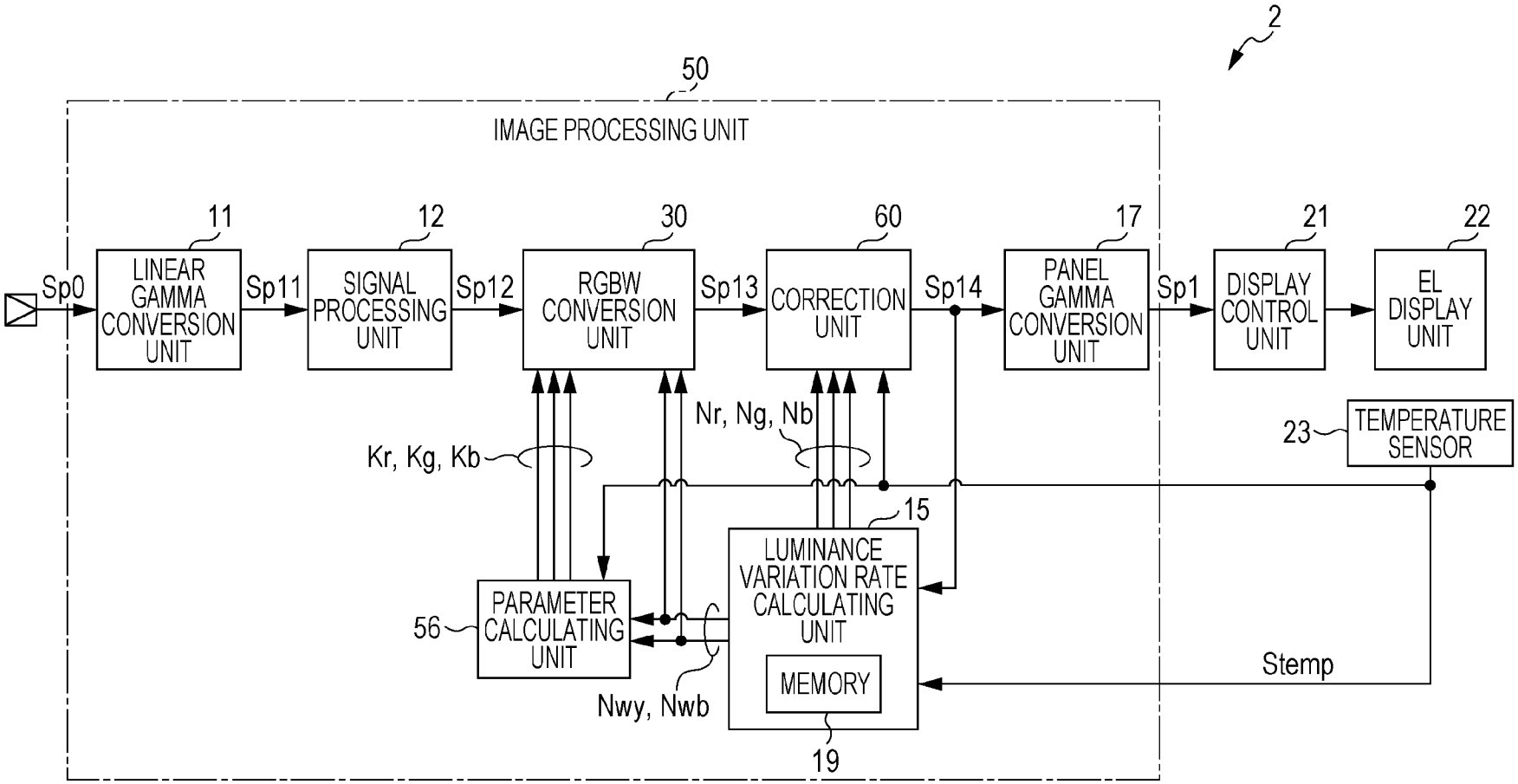
FIG. 21 is a block diagram illustrating a configuration example of a display device according to a second embodiment.

FIG. 21 illustrates a configuration example of the display device 2 according to this embodiment. The display device 2 includes an image processing unit 50. The image processing unit 50 includes a parameter calculating unit 56 and a correction unit 60.

The parameter calculating unit 56 obtains parameters Kr, Kg, and Kb on the basis of luminance variation rates Nwy and Nwb, and a temperature signal Stemp. According to this, the multiplication unit 32 and the correction unit 33 of the RGBW conversion unit 30 can change the conversion characteristics from the luminance information IR, the luminance information IG, and the luminance information IB to the luminance information JR, the luminance information JG, and the luminance information JB in accordance with the luminance variation rates Nwy and Nwb, and the panel temperature.

That is, typically, in the organic EL layer, the light-emission luminance varies in accordance with a temperature, and thus in each sub-pixel 24, luminance varies in accordance with a temperature. In addition, particularly, in the white sub-pixel 24W, in a case where temperature dependency of luminance in the yellow light-emitting layer LY and temperature dependency of luminance in the blue light-emitting layer LB are different from each other, chromaticity also varies in accordance with a temperature. The image processing unit 50 is configured to obtain the parameters Kr, Kg, and Kb also on the basis of the panel temperature in addition to the luminance variation rates Nwy and Nwb. Accordingly, even when the panel temperature varies, it is possible to appropriately perform the RGBW conversion, and thus it is possible to effectively reduce the power consumption.

The correction unit 60 corrects the image signal Sp13 on the basis of the luminance variation rates Nr, Ng, and Nb, and the temperature signal Stemp to generate the image signal Sp14.

Figure 22:
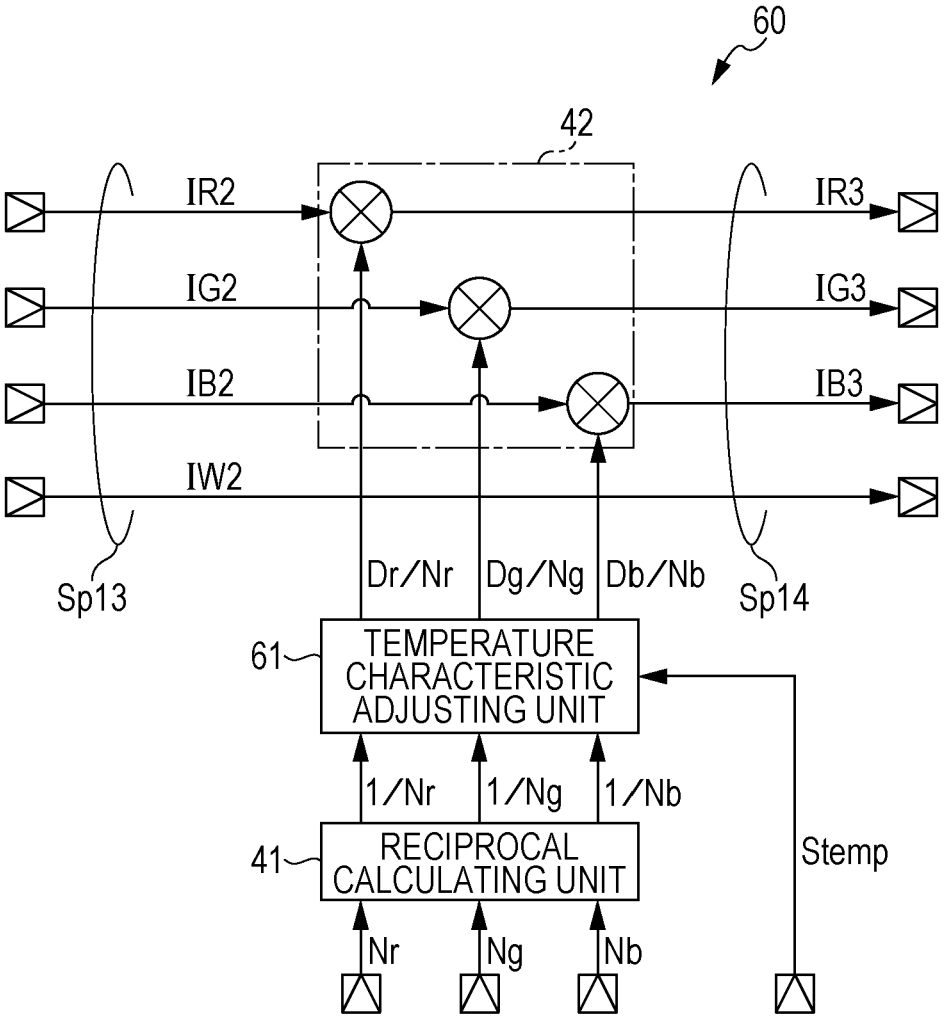
FIG. 22 is a block diagram illustrating a configuration example of a correction unit illustrated in FIG. 21.

FIG. 22 illustrates a configuration example of the correction unit 60. The correction unit 60 includes a temperature characteristic adjusting unit 61. The temperature characteristic adjusting unit 61 generates parameters Dr, Dg, and Db for correction of a temperature variation amount on the basis of the temperature signal Stemp, multiplies the reciprocal "1/Nr" of the luminance variation rate Nr by the parameter Dr (Dr/Nr), multiplies the reciprocal "1/Ng" of the luminance variation rate Ng by the parameter Dg (Dg/Ng), multiplies the reciprocal "1/Nb" of the luminance variation rate Nb by the parameter Db (Db/Nb), and supplies the multiplication results to the multiplication unit 42. According to this, the correction unit 60 can compensate for a decrement in luminance of the sub-pixels 24R, 24G, and 24B due to a variation with the passage of time, and can compensate for a variation in luminance in accordance with the panel temperature.

As described above, in this embodiment, the RGBW conversion is performed in accordance with the panel temperature, and thus it is possible to effectively reduce the power consumption.

In this embodiment, the variation in luminance in accordance with the panel temperature is corrected, and thus it is possible to improve the image quality.

The other effects are substantially the same as those in the case of the first embodiment.

Modification Example 2-1

Each of the modification examples of the first embodiment may be applied to the display device 2 according to the embodiment.

3. Third Embodiment

Next, a display device 3 according to a third embodiment will be described. The display device 3 is configured to obtain the luminance variation rate on the basis of a drive current in the sub-pixel 24 of the EL display unit. In addition, the same reference numerals are given to substantially the same constituent portions as in the display device 1 and the like according to the first embodiment, and description thereof will be appropriately omitted.

Figure 23:
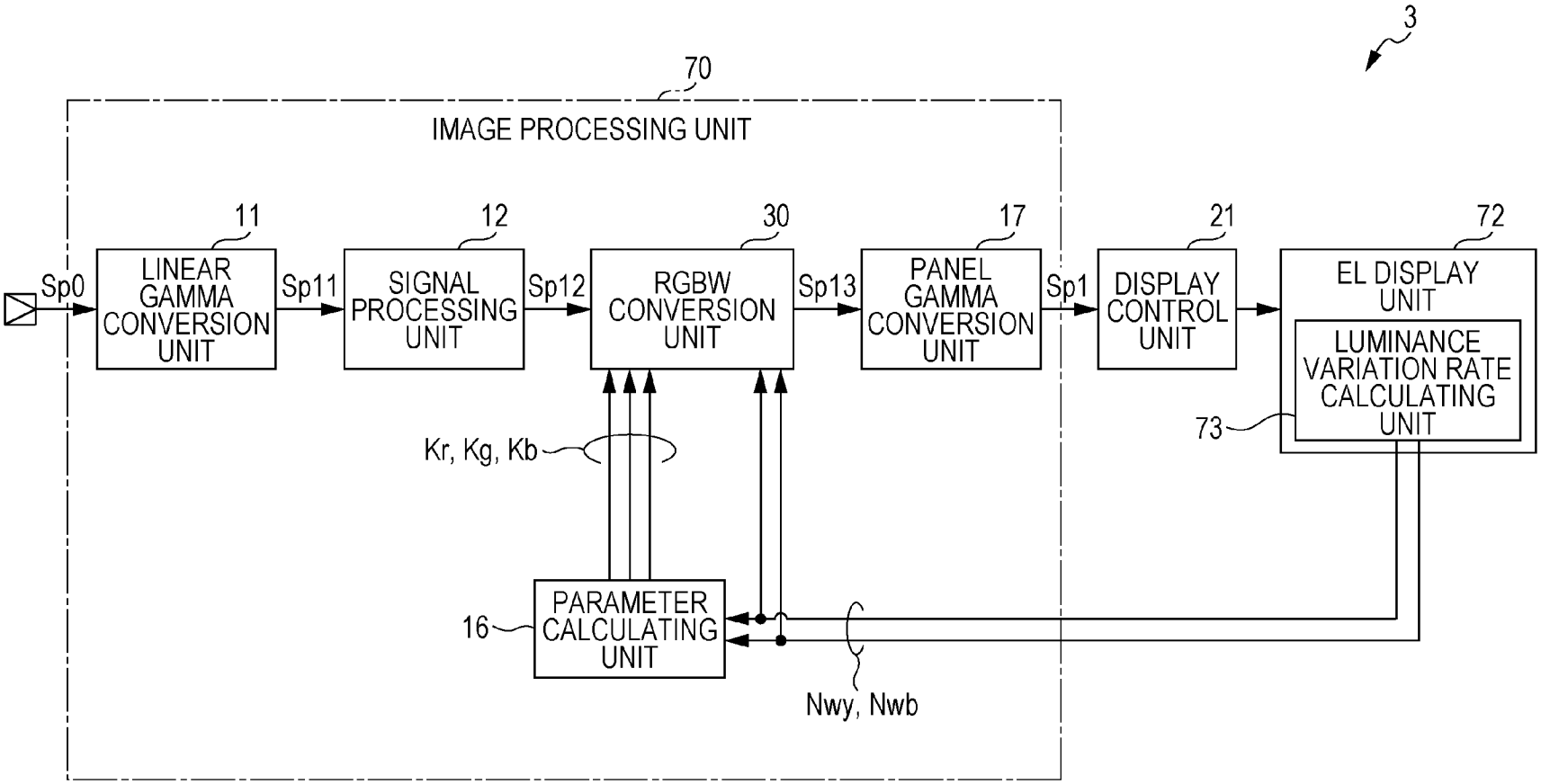
FIG. 23 is a block diagram illustrating a configuration example of a display device according to a third embodiment.

FIG. 23 illustrates a configuration example of the display device 3 according to this embodiment. The display device 3 includes an EL display unit 72, and an image processing unit 70.

The EL display unit 72 is a display unit using an organic EL display element as a display element, and performs a display operation on the basis of control by the display control unit 21. The EL display unit 72 includes a luminance variation rate calculating unit 73. The luminance variation rate calculating unit 73 calculates the luminance variation rate Nwy and Nwb on the basis of a drive current in the white sub-pixel 24W. At that time, for example, the luminance variation rate calculating unit 73 may detect a drive current of the sub-pixel 24W that is used for display. In addition, a dummy sub-pixel 24W may be provided, and then the luminance variation rate calculating unit 73 may detect a drive current of the sub-pixel 24W. The luminance variation rates Nwy and Nwb which are obtained in this manner reflects both the variation in the light-emitting characteristics with the passage of time in the sub-pixel 24W, and the variation in the light-emitting characteristics in accordance with the panel temperature.

The image processing unit 70 includes a linear gamma conversion unit 11, a signal processing unit 12, a parameter calculating unit 16, an RGBW conversion unit 30, and a panel gamma conversion unit 17. That is, the image processing unit 70 has a configuration in which the luminance variation rate calculating unit 15 and the correction unit 40 are omitted from the image processing unit 10 according to the first embodiment.

As described above, in the display device 3, the luminance variation rates Nwy and Nwb are calculated on the basis of the drive current of the sub-pixel 24W, and thus it is possible to make the configuration of the luminance variation rate calculating unit 73 simple. That is, in the luminance variation rate calculating unit 15 according to the first embodiment, the memory 19 is provided, and the luminance variation rate is accumulated on the time axis to calculate the luminance variation rates Nwy and Nwb. On the other hand, in the luminance variation rate calculating unit 73 according to this embodiment, the drive current itself of the sub-pixel 24W varies in accordance with a variation in the light-emitting characteristics with the passage of time in the sub-pixel 24W, and thus it is possible to calculate the luminance variation rates Nwy and Nwb on the basis of the drive current. That is, in the luminance variation rate calculating unit 73, it is not necessary to perform an accumulating operation, and thus it is possible to make a circuit configuration simple.

As described above, in this embodiment, the luminance variation rates Nwy and Nwb are calculated on the basis of the drive current of the sub-pixel 24W, and thus it is possible to make the circuit configuration simple. The other effects are substantially the same as in the case of the first embodiment.

Modification Example 3-1

Figure 24:
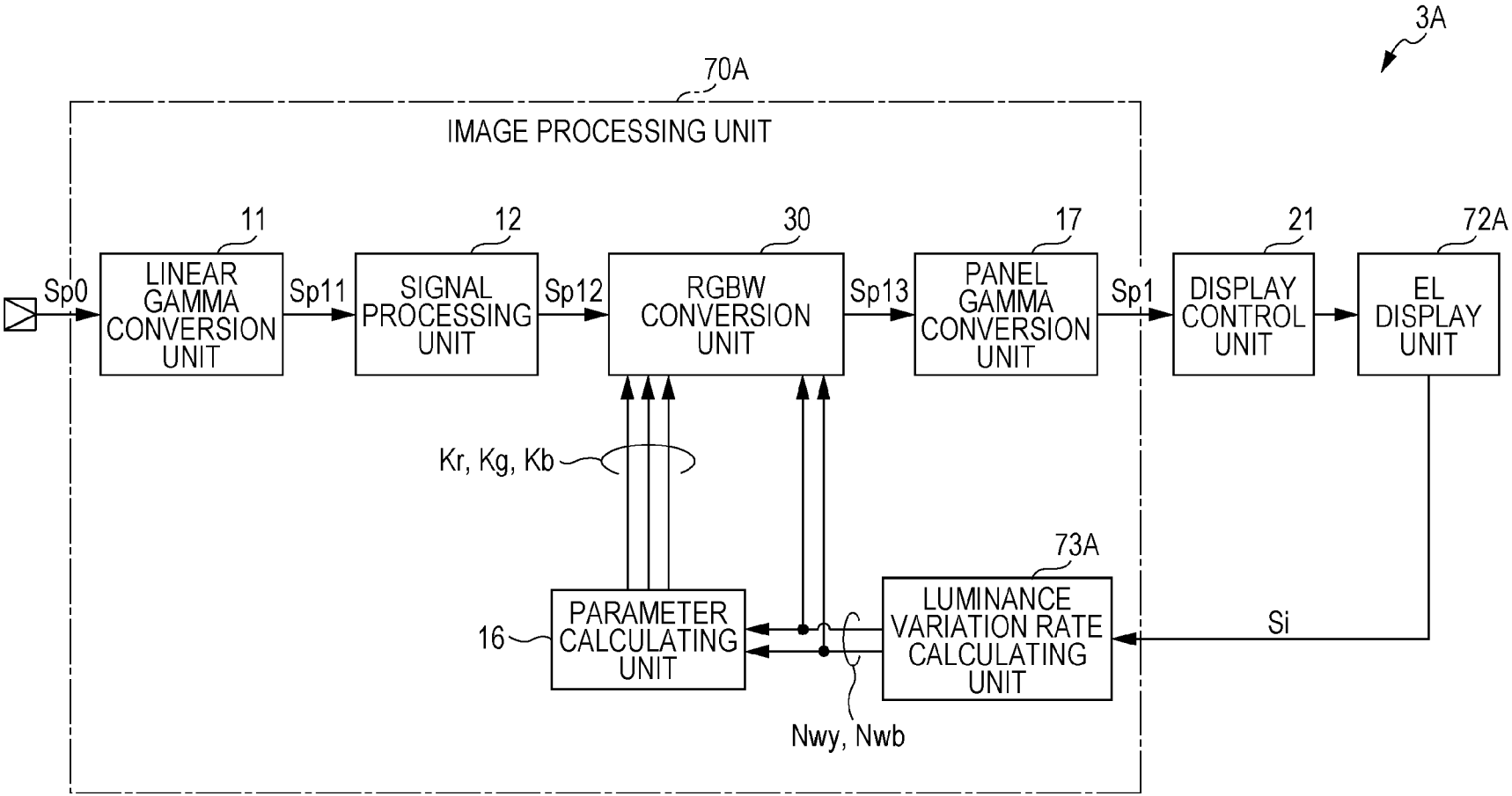
FIG. 24 is a block diagram illustrating a configuration example of a display device according to a modification example of the third embodiment.

In the above-described embodiment, the luminance variation rate calculating unit 73 is provided to the EL display unit 72, but there is no limitation thereto. Instead of this configuration, for example, the luminance variation rate calculating unit 73 may be provided to the image processing unit similar to a display device 3A illustrated in FIG. 24. The display device 3A includes an EL display unit 72A, and an image processing unit 70A. The EL display unit 72A has a configuration in which the luminance variation rate calculating unit 73 is omitted from the EL display unit 72 according to the third embodiment, and supplies information about the drive current in the white sub-pixel 24W to the image processing unit 70A through a signal Si. The image processing unit 70A includes a luminance variation rate calculating unit 73A. The luminance variation rate calculating unit 73A is the same as the luminance variation rate calculating unit 73 according to the third embodiment, and calculates the luminance variation rates Nwy and Nwb on the basis of the signal Si. Even in this configuration, it is possible to obtain the same effect as in the display device 3 according to the third embodiment.

Modification Example 3-2

Figure 25:
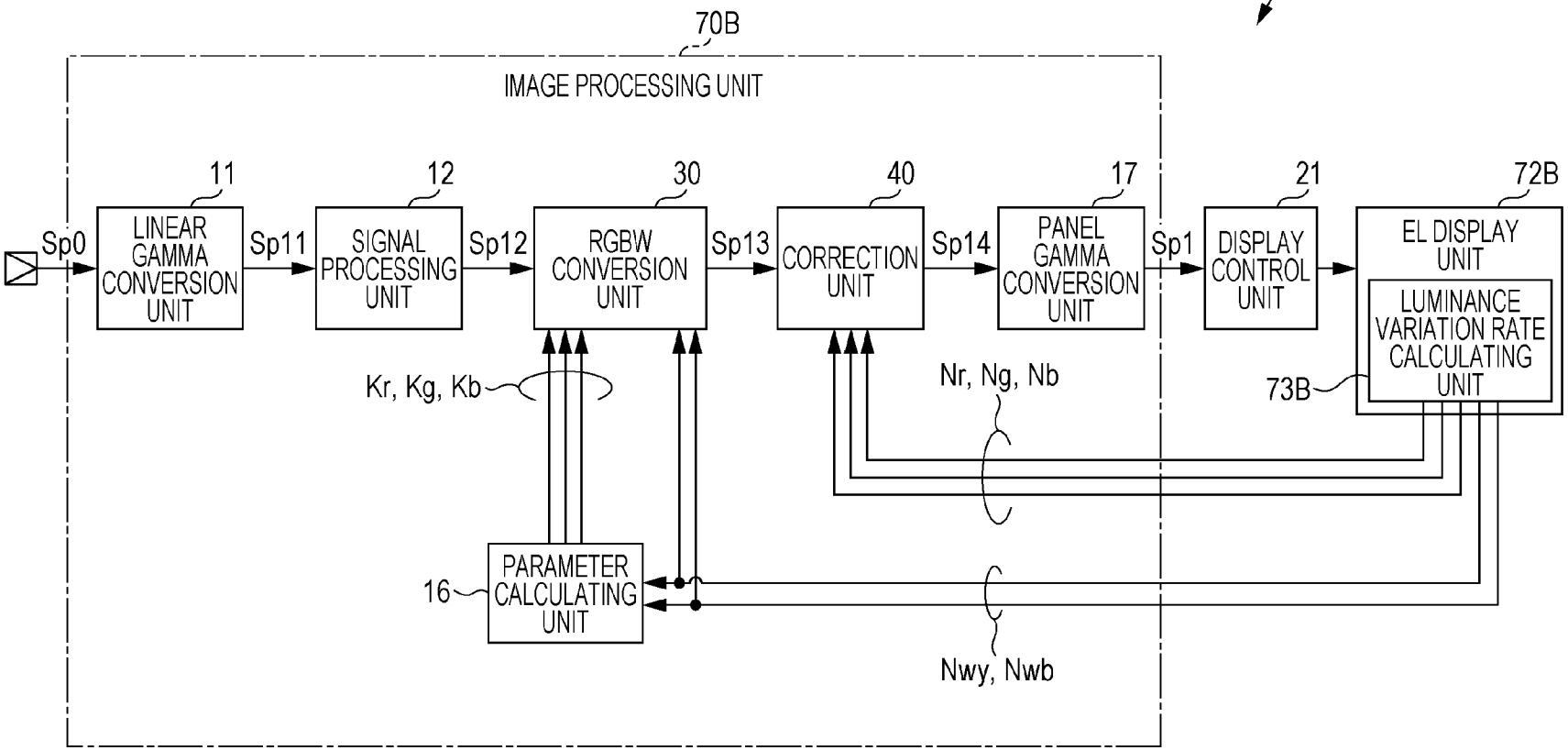
FIG. 25 is a block diagram illustrating a configuration example of a display device according to another modification example of the third embodiment.

In the above-described embodiment, the luminance variation rate calculating unit 73 calculates the luminance variation rates Nwy and Nwb, but there is no limitation thereto. For example, the luminance variation rate calculating unit 73 may also calculate the luminance variation rates Nr, Ng, and Nb similar to a display device 3B illustrated in FIG. 25. The display device 3B includes an EL display unit 72B, and an image processing unit 70B. The EL display unit 72B includes a luminance variation rate calculating unit 73B. The luminance variation rate calculating unit 73B calculates the luminance variation rates Nwy and Nwb on the basis of the drive current in the white sub-pixel 24W. In addition to the calculation, the luminance variation rate calculating unit 73C calculates a luminance variation rate Nr on the basis of a drive current in the red sub-pixel 24R, calculates a luminance variation rate Ng on the basis of a drive current in the green sub-pixel 24G, and calculates a luminance variation rate Nb on the basis of a drive current in the blue sub-pixel 24B. The image processing unit 70B includes the correction unit 40. That is, the image processing unit 70B has a configuration in which the correction unit 40 according to the first embodiment is added to the image processing unit 70 according to the third embodiment. According to this configuration, it is possible to correct the luminance information IR2, the luminance information IG2, and the luminance information IB2 which are included in the image signal Sp13 on the basis of the luminance variation rates Nr, Ng, and Nb, and thus it is possible to improve the image quality.

Modification Example 3-3

In the above-described embodiment, the drive current of the sub-pixel 24W is used during calculation of the luminance variation rates Nwy and Nwb, but there is no limitation thereto. Instead of this configuration, various operation voltages or operation currents in the sub-pixel 24W may be used.

Other Modification Examples

Each of the modification examples of the first embodiment may be applied to the display device 3 according to the above-described embodiment.

4. Application Examples

Next, application examples of the display devices described in the above-described embodiments will be described. The display devices according to the above-described embodiments are applicable to display devices of electronic apparatuses in all fields such as a television apparatus, a digital still camera, a note-type personal computer, a portable terminal apparatus including a cellular phone, and a video camera in which an image signal input from the outside or an image signal generated at the inside is displayed as an image.

Application Example 1

Figure 26:
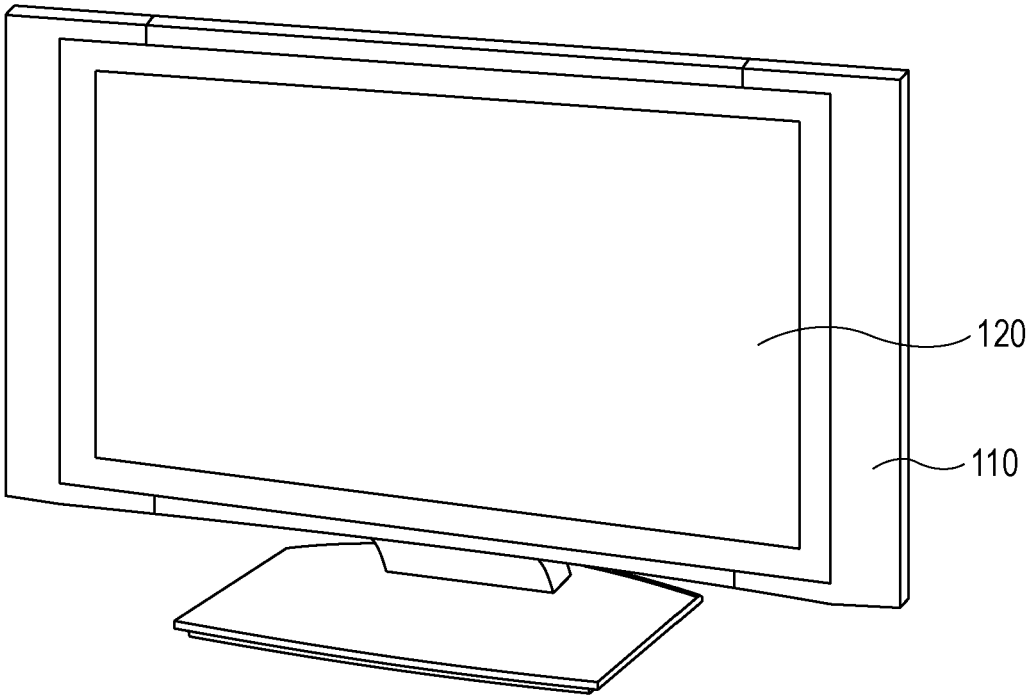
FIG. 26 is a perspective view illustrating an external appearance configuration of a first application example of the display devices according to the embodiments.

FIG. 26 illustrates external appearance of the television device. The television apparatus includes a main body section 110 and a display section 120. The display section 120 is configured by the above-described display device.

Application Example 2

Figure 27:
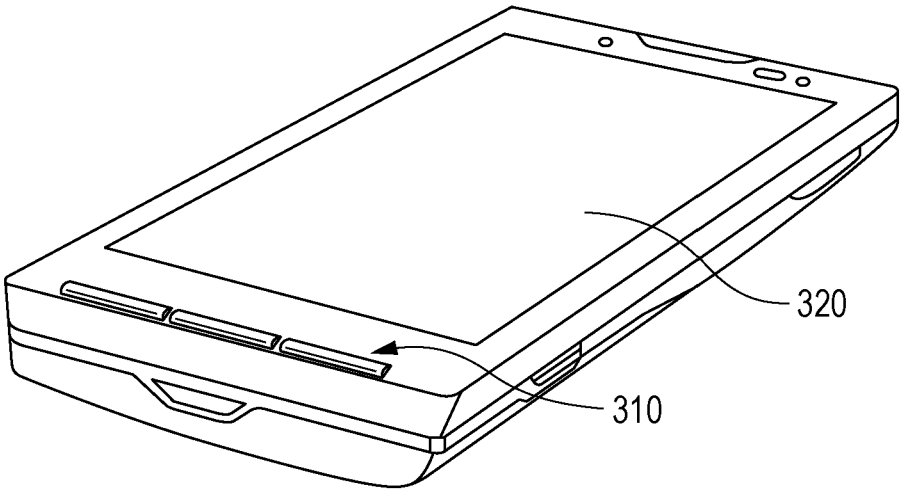
FIG. 27 is a perspective view illustrating an external appearance configuration of a second application example of the display devices according to the embodiments.

FIG. 27 illustrates external appearance of a smart phone. For example, the smart phone includes a main body section 310 and a display section 320, and the display section 320 is configured by the above-described display device.

As described above, the display devices described in the above-described embodiments are applicable to various electronic apparatuses. According to the present disclosure, even when the light-emitting characteristics vary with the passage of time due to a continued use for a long period of time, it is possible to effectively reduce the power consumption.

Hereinbefore, the present disclosure has been described with reference to several embodiments and modification examples thereof, and application examples to electronic apparatuses. However, the present disclosure is not limited to the embodiments, and the like, and various modifications can be made.

For example, in the above-described embodiments, and the like, the display devices are configured by using the organic EL display element, but there is no limitation thereto. Instead of this configuration, for example, various display elements such as an inorganic EL display element can be used.

For example, in the above-described embodiments and the like, the correction units 33, 39, 40, and the like are configured to use the look-up table, but there is no limitation thereto. Instead of this configuration, for example, operation can be performed by using a function.

In addition, the effects described in this specification are illustrative only, and other effects may be provided.

In addition, the present disclosure may be configured as follows.

(1) An image processing device, including: a luminance information generating unit that generates fourth luminance information, which becomes the basis of luminance of a fourth pixel, on the basis of variation characteristics with the passage of time regarding light-emission luminance in the fourth pixel of a display unit including a first pixel, a second pixel, and a third pixel which emit three basic color light beams, and the fourth pixel that emits a non-basic color light beam, and first luminance information, second luminance information, and third luminance information which correspond to the first pixel, the second pixel, and the third pixel, respectively.

(2) The image processing device according to (1), further including: an operation unit that obtains the variation characteristics with the passage of time on the basis of the fourth luminance information.

(3) The image processing device according to (2), wherein the operation unit obtains the variation characteristics with the passage of time also on the basis of a light-emission time.

(4) The image processing device according to (2) or (3), wherein the operation unit obtains the variation characteristics with the passage of time also on the basis of a temperature of the display unit.

(5) The image processing device according to (1), further including: an operation unit that obtains the variation characteristics with the passage of time on the basis of an operation voltage or an operation current in the display unit.

(6) The image processing device according to any one of (1) to (5), further including: a parameter calculating unit that obtains a first parameter, a second parameter, and a third parameter on the basis of the variation characteristics with the passage of time, wherein the luminance information generating unit obtains a first value through linear conversion of the first luminance information by using the first parameter, obtains a second value through linear conversion of the second luminance information by using the second parameter, obtains a third value through linear conversion of the third luminance information by using the third parameter, and generates the fourth luminance information on the basis of the first value, the second value, and the third value.

(7) The image processing device according to (6), wherein the luminance information generating unit corrects the first value, the second value, and the third value on the basis of the variation characteristics with the passage of time, and generates the fourth luminance information on the basis of the minimum value among the corrected first value, the corrected second value, and the corrected third value.

(8) The image processing device according to (6) or (7), wherein wherein the luminance information generating unit generates fifth luminance information, which becomes the basis of luminance of the first pixel, on the basis of the first luminance information, the fourth luminance information, and the first parameter, generates sixth luminance information, which becomes the basis of luminance of the second pixel, on the basis of the second luminance information, the fourth luminance information, and the second parameter, and generates seventh luminance information, which becomes the basis of luminance of the third pixel, on the basis of the third luminance information, the fourth luminance information, and the third parameter.

(9) The image processing device according to (8), wherein the luminance information generating unit corrects the fifth luminance information, the sixth luminance information, and the seventh luminance information on the basis of the variation characteristics with the passage of time.

(10) The image processing device according to (8) or (9), further including: a correction unit that corrects the fourth luminance information, the fifth luminance information, and the sixth luminance information on the basis of variation characteristics with the passage of time regarding light-emission luminance in the first pixel, the second pixel, and the third pixel.

(11) The image processing device according to any one of (6) to (10), wherein the parameter calculating unit obtains the first parameter, the second parameter, and the third parameter on the basis of a temperature of the display unit.

(12) The image processing device according to any one of (1) to (11), wherein the non-basic color light beam is a white light beam.

(13) The image processing device according to any one of (1) to (12), wherein the three basic color light beams include a red light beam, a green light beam, and a blue light beam.

(14) An electronic apparatus, including: a display unit that includes a first pixel, a second pixel, and a third pixel which emit three basic color light beams, and a fourth pixel that emit a non-basic color light beam; an image processing unit; and a control unit that performs operation control with respect to the image processing unit, wherein the image processing unit includes a luminance information generating unit that generates fourth luminance information, which becomes the basis of luminance of the fourth pixel, on the basis of variation characteristics with the passage of time regarding light-emission luminance in the fourth pixel of the display unit, and first luminance information, second luminance information, and third luminance information which correspond to the first pixel, the second pixel, and the third pixel, respectively.

It should be understood by those skilled in the art that various modifications, combinations, sub-combinations and alterations may occur depending on design requirements and other factors insofar as they are within the scope of the appended claims or the equivalents thereof.

What is claimed is:

1. An image processing device comprising:

a luminance information generating unit that generates fourth luminance information on a basis of variation characteristics with a passage of time regarding light-emission luminance in a fourth sub-pixel of a display unit, wherein the fourth luminance information becomes a basis of luminance of the fourth sub-pixel, wherein the display unit further includes a first sub-pixel, a second sub-pixel, and a third sub-pixel that emit one of three basic color light beams, and the fourth sub-pixel that emits a non-basic color light beam, and wherein first luminance information, second luminance information, third luminance information, and the fourth luminance information correspond to the first sub-pixel, the second sub-pixel, the third sub-pixel, and the fourth sub-pixel, respectively.

2. The image processing device according to claim 1, further comprising:

an operation unit that obtains the variation characteristics with the passage of time on a basis of luminance information.

3. The image processing device according to claim 2, wherein the operation unit obtains the variation characteristics with the passage of time also on a basis of a light-emission time.

4. The image processing device according to claim 2, wherein the operation unit obtains the variation characteristics with the passage of time also on a basis of a temperature of the display unit.

5. The image processing device according to claim 1, further comprising:

an operation unit that obtains the variation characteristics with the passage of time on a basis of an operation voltage or an operation current in the display unit.

6. The image processing device according to claim 1, wherein the non-basic color light beam is a white light beam.

7. The image processing device according to claim 1, wherein the three basic color light beams include a red light beam, a green light beam, and a blue light beam.

8. An image processing device comprising:

a luminance information generating unit that generates fourth luminance information on a basis of variation characteristics with a passage of time regarding light-emission luminance in a fourth sub-pixel of a display unit, wherein the fourth luminance information becomes a basis of luminance of the fourth sub-pixel, wherein the display unit further includes a first sub-pixel, a second sub-pixel, and a third sub-pixel that emit one of three basic color light beams, and the fourth sub-pixel that emits a non-basic color light beam, and wherein first luminance information, second luminance information, third luminance information, and the fourth luminance information correspond to the first sub-pixel, the second sub-pixel, the third sub-pixel, and the fourth sub-pixel, respectively; and a parameter calculating unit that obtains a first parameter, a second parameter, and a third parameter on the basis of the variation characteristics with the passage of time, wherein the luminance information generating unit obtains a first value through linear conversion of the first luminance information by using the first parameter, obtains a second value through linear conversion of the second luminance information by using the second parameter, obtains a third value through linear conversion of the third luminance information by using the third parameter, and generates the fourth luminance information on the basis of the first value, the second value, and the third value.

9. The image processing device according to claim 8, wherein the luminance information generating unit corrects the first value, the second value, and the third value on the basis of the variation characteristics with the passage of time, and generates the fourth luminance information on the basis of a minimum value among a corrected first value, a corrected second value, and a corrected third value.

10. The image processing device according to claim 8, wherein the luminance information generating unit generates fifth luminance information, which becomes the basis of luminance of the first sub-pixel, on the basis of the first luminance information, the fourth luminance information, and the first parameter, generates sixth luminance information, which becomes the basis of luminance of the second sub-pixel, on the basis of the second luminance information, the fourth luminance information, and the second parameter, and generates seventh luminance information, which becomes the basis of luminance of the third sub-pixel, on the basis of the third luminance information, the fourth luminance information, and the third parameter.

11. The image processing device according to claim 10, wherein the luminance information generating unit corrects the fifth luminance information, the sixth luminance information, and the seventh luminance information on the basis of the variation characteristics with the passage of time.

12. The image processing device according to claim 10, further comprising:

a correction unit that corrects the fourth luminance information, the fifth luminance information, and the sixth luminance information on the basis of variation characteristics with the passage of time regarding light-emission luminance in the first sub-pixel, the second sub-pixel, and the third sub-pixel.

13. The image processing device according to claim 8, wherein the parameter calculating unit obtains the first parameter, the second parameter, and the third parameter on the basis of a temperature of the display unit.

14. An electronic apparatus comprising:

a display unit that includes a first sub-pixel, a second sub-pixel, and a third sub-pixel that emit one of which emit three basic color light beams, and a fourth sub-pixel that emits a non-basic color light beam;

an image processing unit that includes a luminance information generating unit that generates fourth luminance information on a basis of variation characteristics with a passage of time regarding light-emission luminance in the fourth sub-pixel of the display unit, wherein the fourth luminance information becomes a basis of luminance of the fourth sub-pixel, and wherein first luminance information, second luminance information, third luminance information, and the fourth luminance information correspond to the first sub-pixel, the second sub-pixel, the third sub-pixel, and the fourth sub-pixel, respectively; and a control unit that performs operation control with respect to the image processing unit.

15. The electronic apparatus according to claim 14, wherein the image processing unit further includes an operation unit that obtains the variation characteristics with the passage of time on a basis of luminance information.

16. The electronic apparatus according to claim 15, wherein the operation unit obtains the variation characteristics with the passage of time also on a basis of a light-emission time.

17. The electronic apparatus according to claim 15, wherein the operation unit obtains the variation characteristics with the passage of time also on a basis of a temperature of the display unit.

18. The electronic apparatus according to claim 14, wherein the image processing unit further includes an operation unit that obtains the variation characteristics with the passage of time on a basis of an operation voltage or an operation current in the display unit.

19. The electronic apparatus according to claim 14, wherein the non-basic color light beam is a white light beam, and wherein the three basic color light beams include a red light beam, a green light beam, and a blue light beam.

20. The electronic apparatus according to claim 14, wherein the image processing unit further includes a parameter calculating unit that obtains a first parameter, a second parameter, and a third parameter on the basis of the variation characteristics with the passage of time, and wherein the luminance information generating unit obtains a first value through linear conversion of the first luminance information by using the first parameter, obtains a second value through linear conversion of the second luminance information by using the second parameter, obtains a third value through linear conversion of the third luminance information by using the third parameter, and generates the fourth luminance information on the basis of the first value, the second value, and the third value.

* * * * *